US009441363B2

(12) United States Patent
Lewin

(10) Patent No.: US 9,441,363 B2
(45) Date of Patent: Sep. 13, 2016

(54) PREFABRICATED WALL APPARATUS AND METHOD

(71) Applicant: Richard Lewin, Toronto (CA)

(72) Inventor: Richard Lewin, Toronto (CA)

( * ) Notice: Subject to any disclaimer, the term of this patent is extended or adjusted under 35 U.S.C. 154(b) by 0 days.

(21) Appl. No.: 14/021,683

(22) Filed: Sep. 9, 2013

(65) Prior Publication Data

US 2015/0068137 A1 Mar. 12, 2015

(51) Int. Cl.

| | |
|---|---|
| ***E04C 2/10*** | (2006.01) |
| ***E04B 1/90*** | (2006.01) |
| ***E04B 1/86*** | (2006.01) |
| ***E04C 2/00*** | (2006.01) |
| *E04B 1/84* | (2006.01) |

(52) U.S. Cl.

CPC ..... *E04B 1/90* (2013.01); *E04B 1/8404* (2013.01); *E04B 1/86* (2013.01); *E04C 2/00* (2013.01); *E04B 2001/8452* (2013.01)

(58) Field of Classification Search

CPC .... E04B 1/62; E04B 1/66; E04B 2001/8452; E04B 1/90; E04B 1/86; E04B 1/8404

USPC ..... 52/309.8, 309.9, 98, 100, 309.7

See application file for complete search history.

(56) References Cited

U.S. PATENT DOCUMENTS

| | | | | |
|---|---|---|---|---|
| 2,094,635 | A * | 10/1937 | Brooks | 52/407.3 |
| 4,628,650 | A | 12/1986 | Parker | |
| 4,641,468 | A * | 2/1987 | Slater | 52/309.4 |
| 4,702,046 | A * | 10/1987 | Haugen et al. | 52/144 |
| 4,815,243 | A * | 3/1989 | Pardo | 52/100 |
| 5,079,885 | A | 1/1992 | Dettbarn | |
| 5,638,651 | A | 6/1997 | Ford | |
| 5,765,330 | A | 6/1998 | Richard | |
| 5,771,645 | A * | 6/1998 | Porter | 52/220.2 |
| 6,026,628 | A * | 2/2000 | Lopez | 52/745.09 |
| 6,226,943 | B1 * | 5/2001 | Grinshpun et al. | 52/309.4 |
| 6,571,523 | B2 * | 6/2003 | Chambers | 52/309.2 |
| 7,568,318 | B1 | 8/2009 | Egan | |
| 7,963,080 | B1 * | 6/2011 | Bowman | 52/414 |
| 8,109,058 | B2 | 2/2012 | Miller | |
| 8,438,792 | B2 * | 5/2013 | Schwartz | 52/92.2 |
| 8,567,153 | B1 * | 10/2013 | Francavilla | 52/741.13 |
| 2006/0117689 | A1 | 6/2006 | Onken | |

(Continued)

FOREIGN PATENT DOCUMENTS

| | | |
|---|---|---|
| CA | 1116371 | 1/1982 |
| CA | 1124482 | 6/1982 |

*Primary Examiner* — Adriana Figueroa

(74) *Attorney, Agent, or Firm* — Bereskin & Parr LLP/S.E.N.C.R.L., s.r.l.; Kenneth L. Bousfield

(57) ABSTRACT

A prefabricated wall module may include framing members and one or more insulations members. The insulation member may have pre-incisions, as made by a hot-wire, defining service fitting accommodations. The service fitting accommodations are accessible on the inside face of the insulation. The service fitting accommodations may be either or both of vertically or laterally extending, and are located in the same places in each module, the vertical locations being next to the studs, to which service fittings may typically be mounted, the lateral accommodations being at heights typical of switches and wall outlets. The insulation members may be supplied with tabs filling the accommodations. The tabs may be snapped out as required. The insulation members may have stud channels that are shallower than the studs, such that an air gap is established between the insulation and the internal gypsum board covering.

28 Claims, 15 Drawing Sheets

Figure 1A:
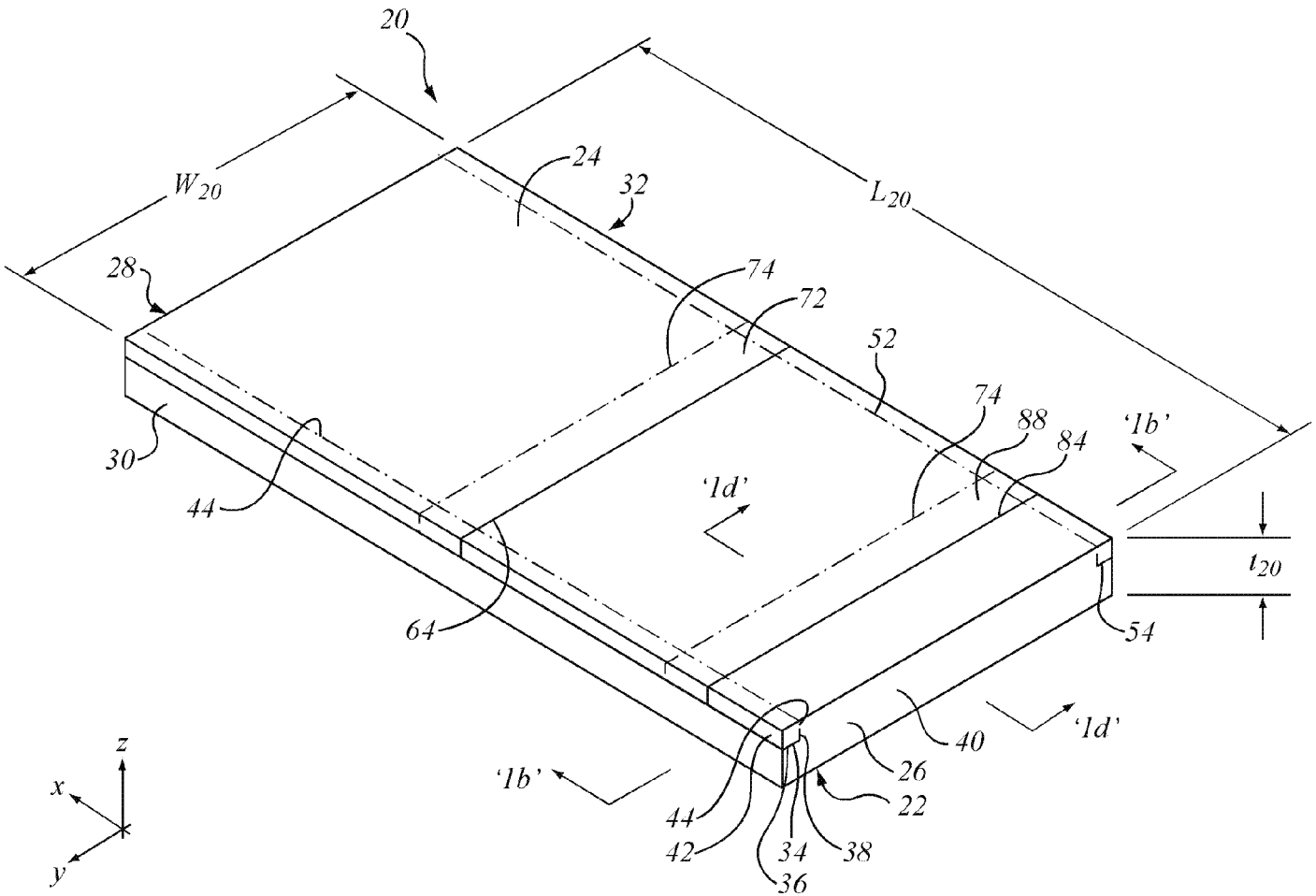

(56) References Cited * cited by examiner

U.S. PATENT DOCUMENTS

2010/0325999 A1* 12/2010 Devalapura ..... E04B 1/7654
52/506.05
2012/0096785 A1* 4/2012 Weeks ..... 52/220.1

PREFABRICATED WALL APPARATUS AND METHOD

FIELD OF INVENTION

This description relates to an insulated wall construction apparatus and method.

BACKGROUND OF THE INVENTION

A modular wall panel typically includes a combination of framing elements and insulation. It may also include inside sheathing, typically gypsum wall board of some kind, and external or outside sheathing which may be plywood or oriented strand board. Modular insulated walls are addressed in U.S. Pat. No. 4,628,650 of Parker, for example.

SUMMARY OF INVENTION

The following summary may introduce the reader to the more detailed discussion to follow. The summary is not intended to, and does not, limit or define the claims.

In an aspect of the invention there is an insulation monolith with snap-out service accommodation access. In a feature of that aspect, the service accommodation is accessible from front face of the unit, i.e., the face facing inwardly toward the room of which the module forms a portion of the wall. In another aspect of the invention, there is a method of making any aspect of feature of apparatus shown or described herein.

In another aspect of the invention there is an insulation monolith with an end stud accommodation, the end stud accommodation being of selectable width between at least a first width and a second width greater than the first width.

In another aspect of the invention there is an insulation monolith that defines a wall framing jig, that aspect including the method of using the jig to construct a wall module thereon, whereby the wall module may be said to be self-jigging.

In another aspect of the invention there is an insulation member for use in construction of a modular wall structure including wall studs, wherein the insulation member includes at least one stud accommodation, and the stud has a width that is greater than the depth of the stud accommodation.

In another aspect of the invention, there is an insulation member for use in construction of a modular wall structure including wall studs, where the insulation member defines a plug conforming to a bay or cavity defined between a pair of adjacent studs, wherein the plug is shallower than the cavity. In a feature of that aspect of the invention, the insulation member also has an abutment, or indexing element that seats outside the studs, while the plug extends inwardly from the indexing member into the cavity. In another feature, the insulation member includes at least one stud channel, and, when a first stud is installed therein it stands proud of the plug in the inside direction relative to the wall.

In an aspect of the invention there is an insulation member for a pre-fabricated wall construction. It has a body having a height, a width and a depth. The body has at least a first stud accommodation and a second stud accommodation defined therein. The first and second stud accommodations are spaced width-wise apart from each other, and run height-wise. The body has an outside face and an inside face. The first and second stud accommodations are shallower than the depth of the body, and open toward the inside face. The body has at least a first service accommodation defined therein, the first service accommodation being adjacent to the first stud accommodation, and being located between the first and second stud accommodations. The first service accommodation has access from the inside face.

In a feature of that aspect of the invention, the body includes an accommodation for at least one of (a) a head plate; and (b) a foot plate. In another feature, the first service accommodation runs heighth-wise along the first stud accommodation. In another feature, a second service accommodation is located adjacent to the second stud accommodation. In a further feature, the first service accommodation runs heighth-wise along the first stud accommodation, and the second service accommodation runs heighth-wise along the second stud accommodation. In still another feature, the first service accommodation extends width-wise between the first and second stud accommodations. In an additional feature a second service accommodation extends width-wise between the first and second stud accommodations. In another feature, the first service accommodation is shallower than the first stud accommodation. In another feature, the first service accommodation is at least ¾ inches deep.

In another feature there is a combination of the insulated member and a first insulation blank, the first insulation blank conforming to the first service accommodation; and the first insulation blank being movable to govern access to the first service accommodation.

In another aspect of the invention there is a pre-fabricated insulation member having a body portion for installation between first and second wall studs, the insulation member having a height, a width, and a through-thickness, the through-thickness being smaller than either of the height and the width. The insulation member body portion has a first face, the first face extending heighth-wise and width-wise. The body portion has a first service accommodation predefined therein. The service accommodation is accessible from the first face.

In a feature of that aspect, the insulation member has a first stud interface and the first service accommodation runs adjacent to the first stud interface. In another feature, the member has a first stud interface and a second stud interface, and the first service accommodation runs width-wise across the body portion between the first and second stud interfaces. In a further feature, the member has a first stud interface and a second stud interface, the first service accommodation runs along the first stud interface, and the insulation member has a second service accommodation running along the second stud interface; the second service accommodation being accessible from the first face. In a still further feature, the body member has a first stud interface and a second stud interface. The prefabricated insulation member also includes a second service accommodation. The first service accommodation runs predominantly heighth-wise along the first stud interface. The second service accommodation runs width-wise between the first stud interface and the second stud interface. In an additional feature, the body member has a third service accommodation. The third service accommodation running along the second stud interface; and the third service accommodation being accessible from the first face.

In still another feature, the pre-fabricated insulation member includes a second member; the second member fitting within the first service accommodation; and the second member being removable from the first service accommodation. In another feature, a frangible blank occupies the first service accommodation. In a further feature, the body member and the frangible blank are parts of a single insulation monolith. In another further feature, the first service accommodation is shallower than the through-thickness of the body member.

In another aspect of the invention, there is a combination of an insulation member for a pre-fabricated wall construction and framing members of the pre-fabricated wall construction. The framing members include at least first and second spaced-apart studs and a cavity formed therebetween. The wall construction has a height, a width, and a through-thickness. The framing members include at least first and second spaced-apart studs, the studs having a thickness and a width, and a cavity formed between the first and second studs. The cavity has a depth in the through-thickness direction of the wall-construction. The insulation member defines a plug for the cavity, and the plug is shorter in the through-thickness direction than the depth of the cavity.

In a feature of that aspect of the invention, the insulation member has respective first and second stud interface fittings defining respective accommodations for the first and second studs, and the respective accommodations are each less deep in the through-thickness direction of the wall construction than the width of the first and second studs in the through-thickness direction of the wall construction. In another feature, the wall construction has an inside and an outside, the studs stand proud of the plug toward the inside of the wall construction, and the plug has at least a first service fitting accommodation defined therein, the first service fitting accommodation being accessible from the inside of the wall construction. In a further feature, the first service fitting accommodation is filled with a blank. In an additional feature, the blank is frangibly removable from the accommodation. In another feature, the combination includes at least three studs and at least two adjacent cavities defined to either side of one of the at least three studs; the first stud seats in a stud channel defined in the insulated member, and the first service fitting accommodation runs along the first stud adjacent to the stud channel. In another feature the first and second stud accommodations are formed on one of (a) 12" centers; (b) 16" centers; (c) 19½" centers; (d) 24" centers.

BRIEF DESCRIPTION OF THE ILLUSTRATIONS

Figure 1B:
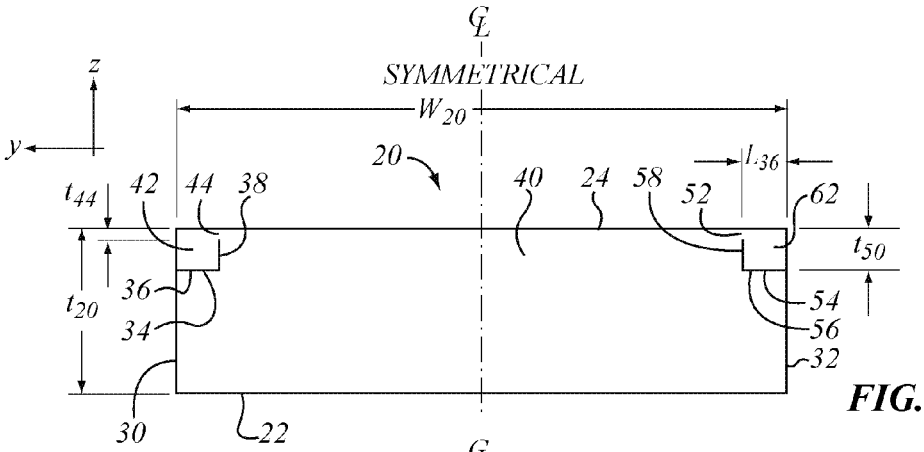
Figure 1C:
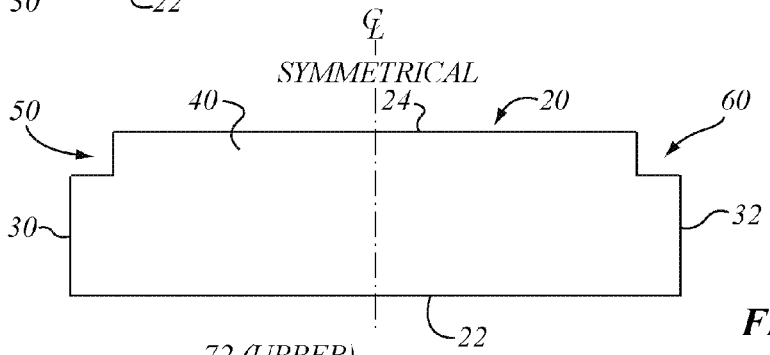
Figure 1D:
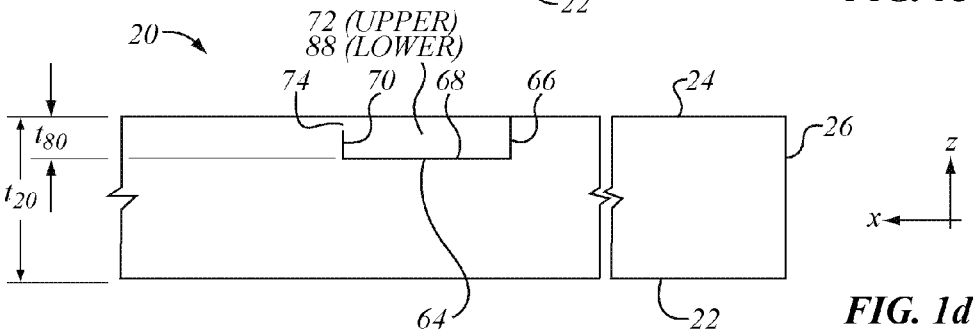
Figure 1E:
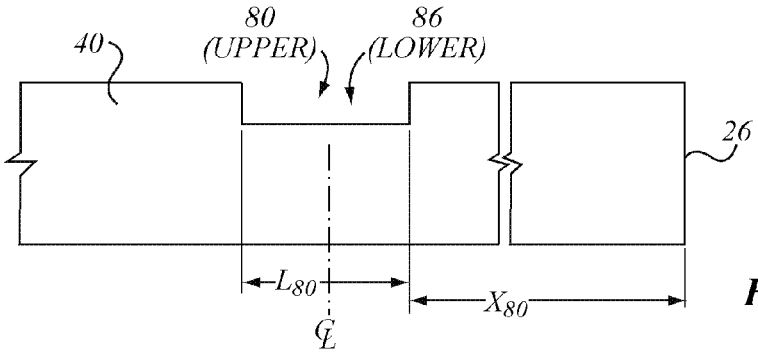
Figure 2A:
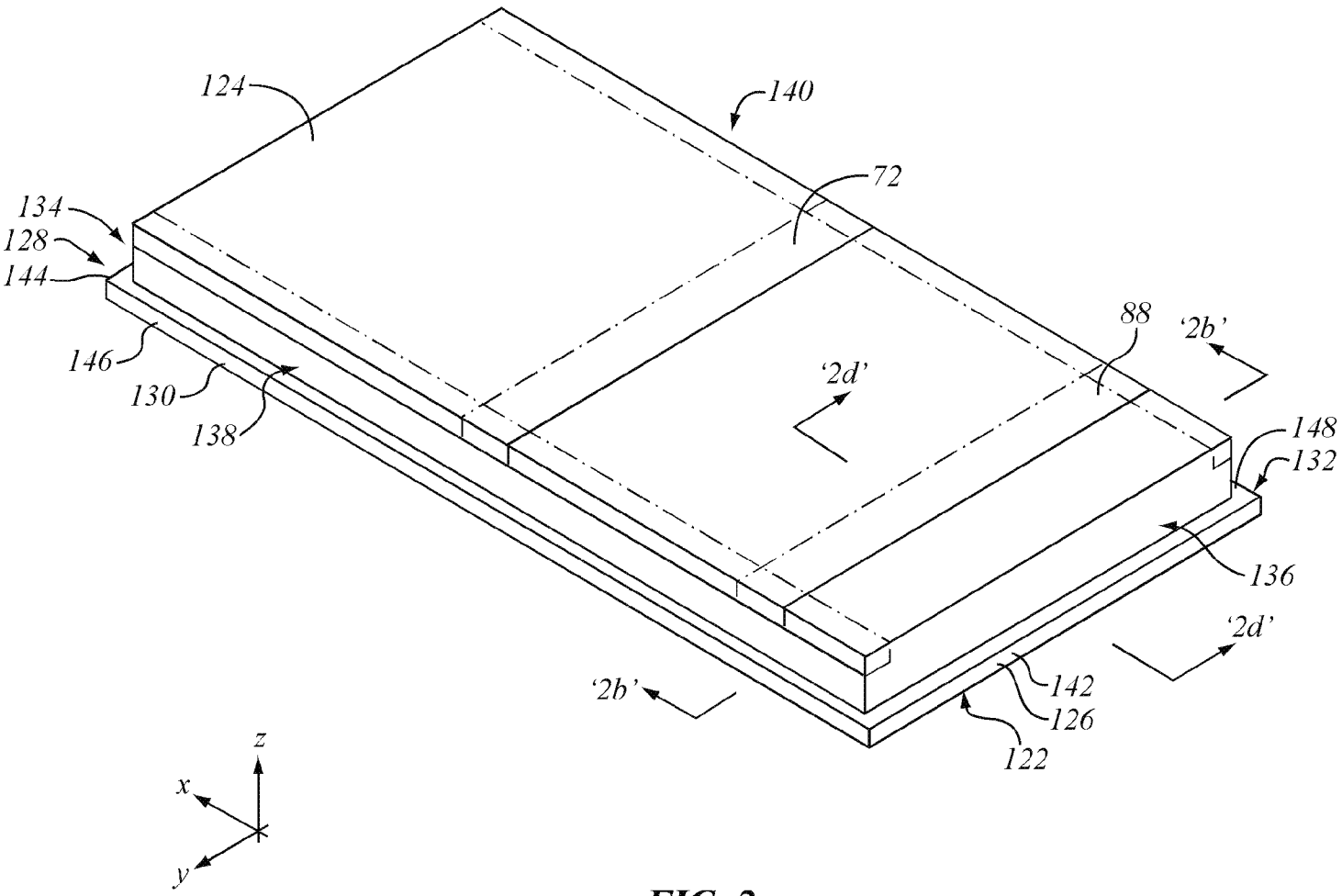

These and other features and aspects of the invention may be explained and understood with the aid of the accompanying illustrations, in which:

FIG. 1*a* is a perspective view of a pre-fabricated insulation member according to an aspect of the invention herein;

FIG. 1*b* is a sectional view on section '1*b*-1*b*' of FIG. 1*a*, with cross-hatching omitted for clarity;

FIG. 1*c* is the sectional view of FIG. 1*b* with two heighth-wise extending frangible members removed;

FIG. 1*d* is a partial sectional view of section '1*d*-1*d*' of FIG. 1*a*, with cross-hatching omitted for clarity;

FIG. 1*e* is the sectional view of FIG. 1*d* with a width-wise extending frangible member removed;

FIG. 2*a* is a perspective view of an alternate embodiment of pre-fabricated insulation member to that of FIG. 1*a;*

Figure 2B:
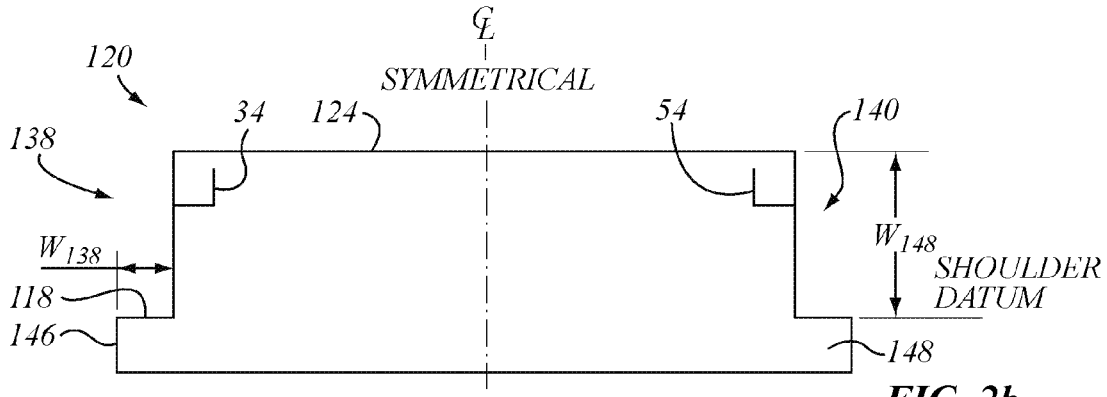
Figure 2C:
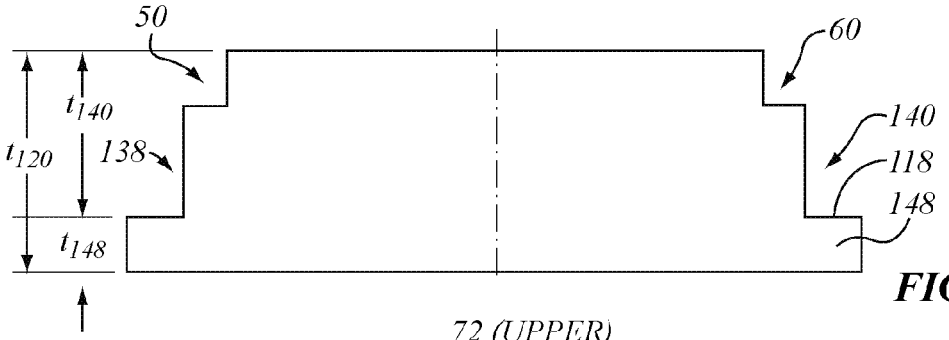
Figure 2D:
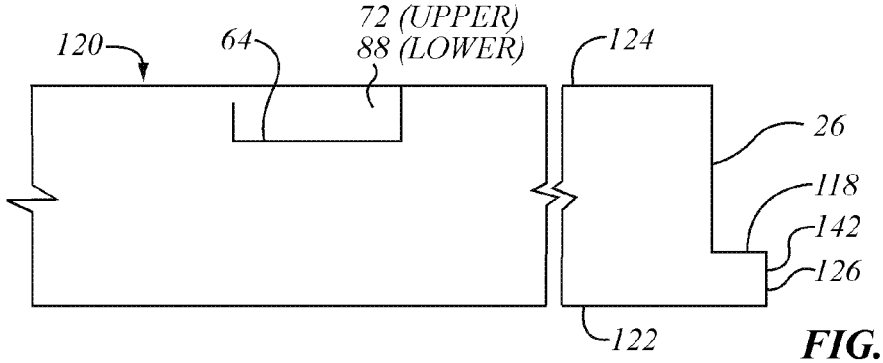
Figure 2E:
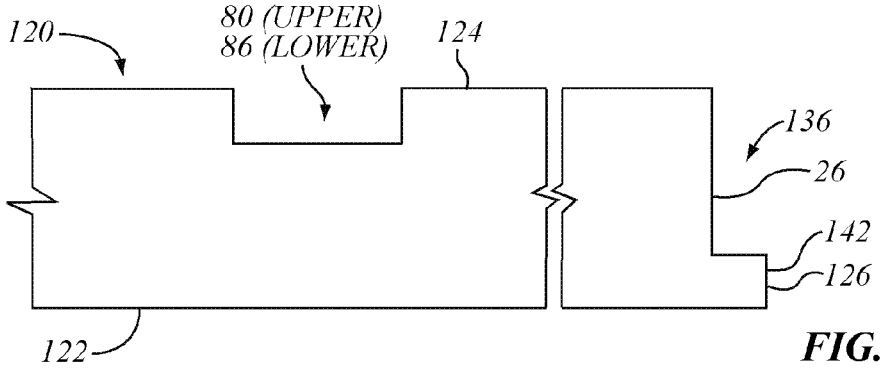
Figure 3A:
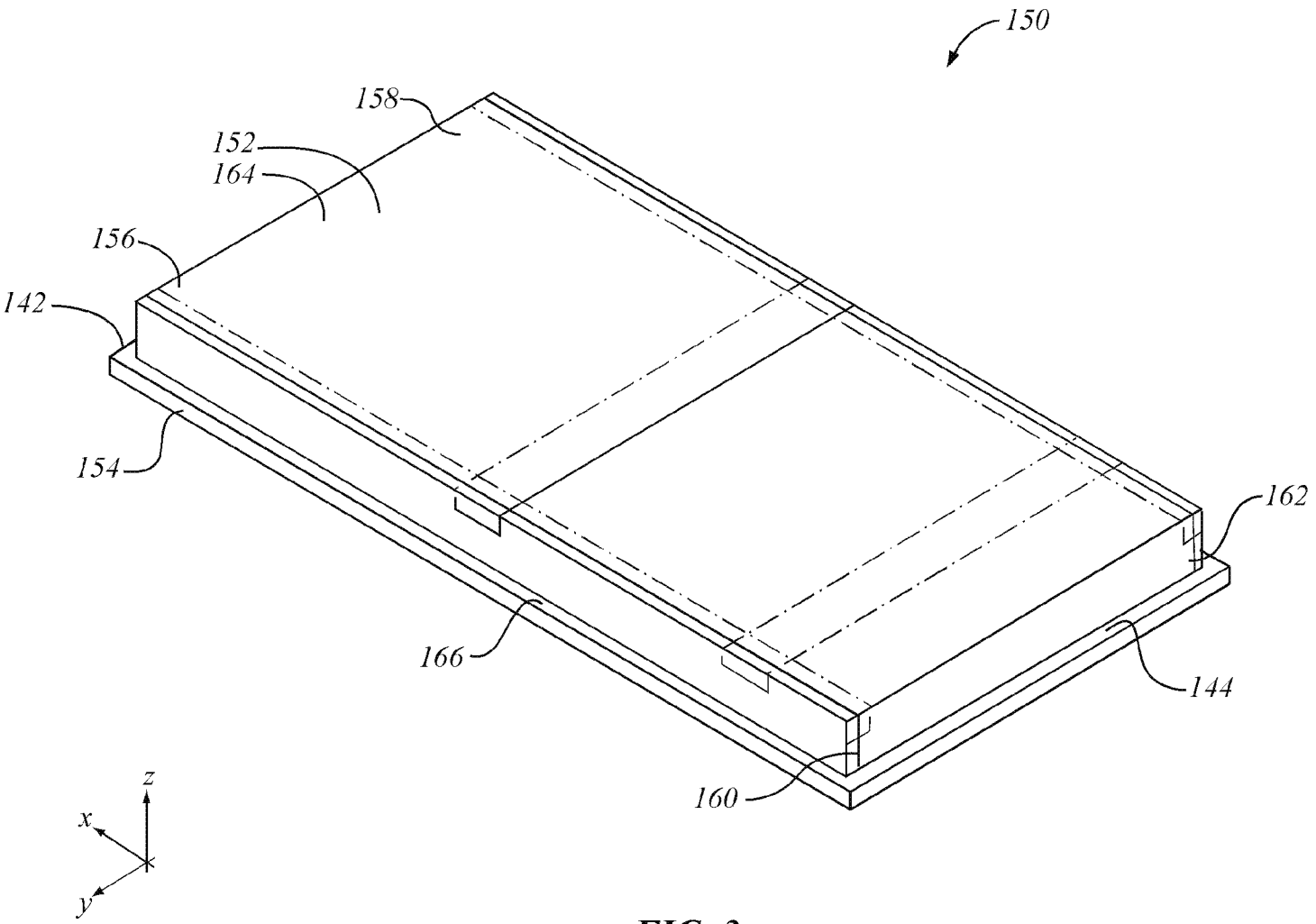

FIG. 2*b* is a sectional view on section '2*b*-2*b*' of FIG. 2*a*, with cross-hatching omitted for clarity;

FIG. 2*c* is the sectional view of FIG. 2*b* with two heighth-wise extending frangible members removed;

FIG. 2*d* is a partial sectional view of section '2*d*-2*d*' of FIG. 2*a*, with cross-hatching omitted for clarity;

FIG. 2*e* is the sectional view of FIG. 2*d* with a width-wise extending frangible member removed;

FIG. 3*a* is a perspective view of a further alternate embodiment of pre-fabricated insulation member to that of FIG. 1*a;*

Figure 3B:
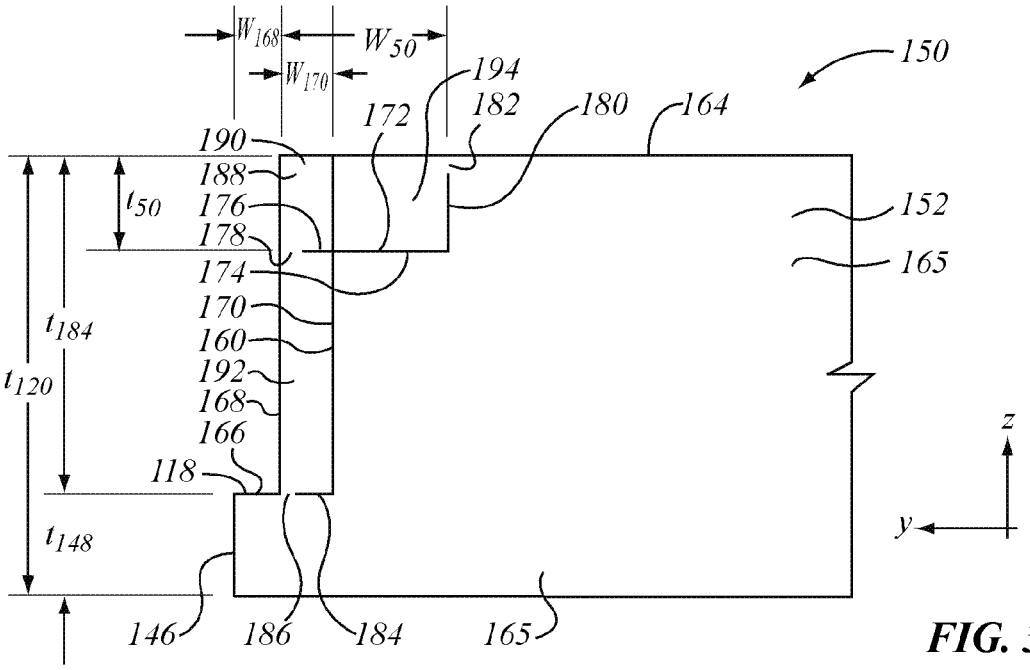

FIG. 3*b* is a corner sectional detail taken on section '3*b*-3*b*' of the pre-fabricated insulation member of FIG. 3*a;*

Figure 4B:
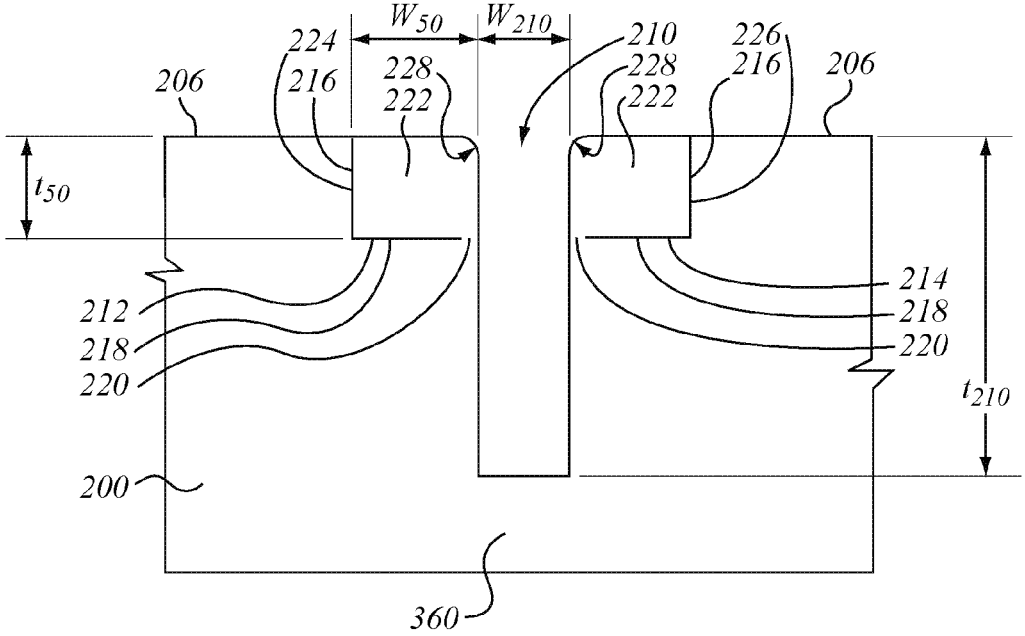
Figure 4A:
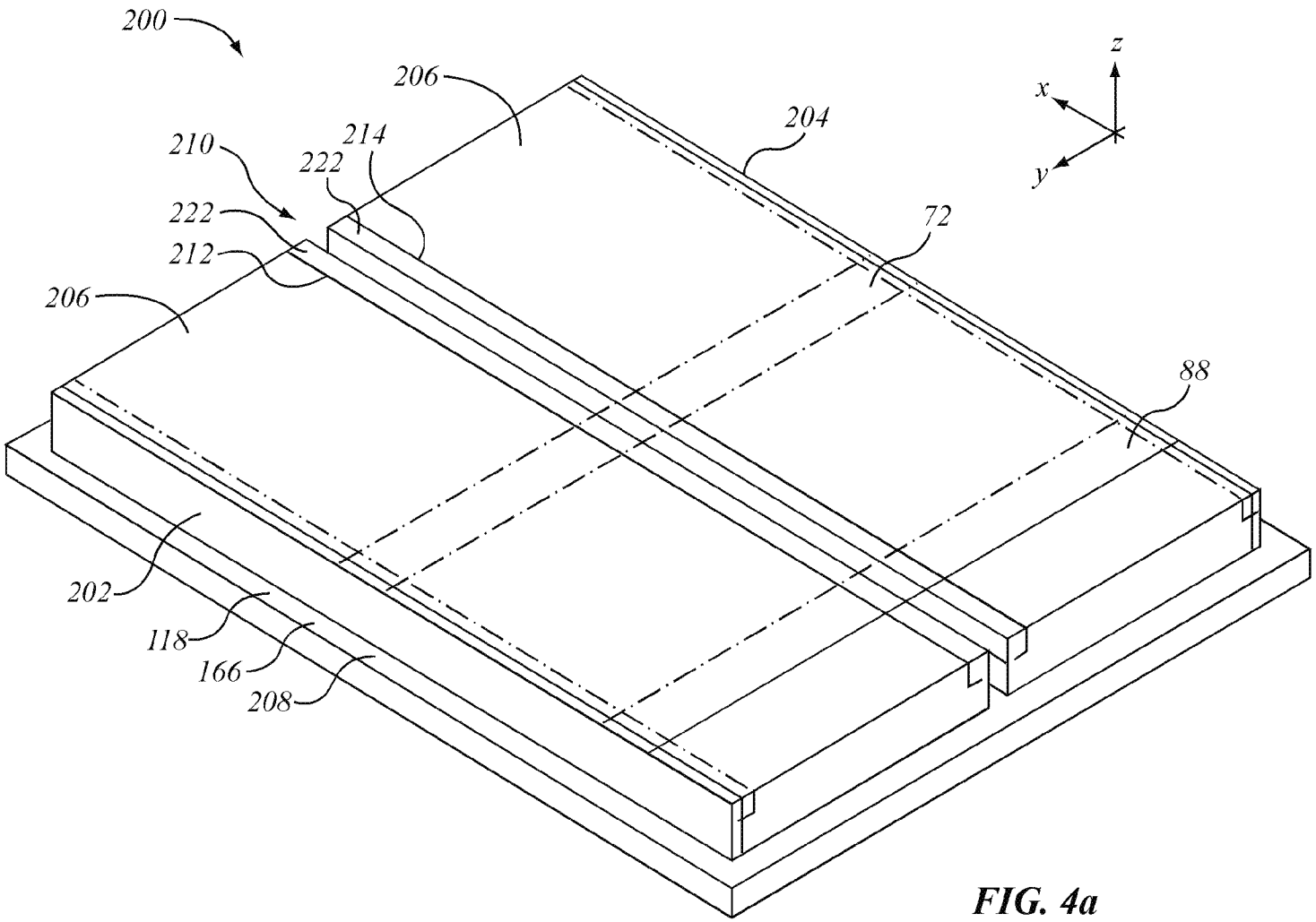

FIG. 4*a* is a perspective view of a further alternate embodiment of pre-fabricated insulation member to that of FIG. 1*a;*

FIG. 4*b* is a corner sectional detail taken on section '4*b*-4*b*' of the pre-fabricated insulation member of FIG. 4*a;*

Figure 5A:
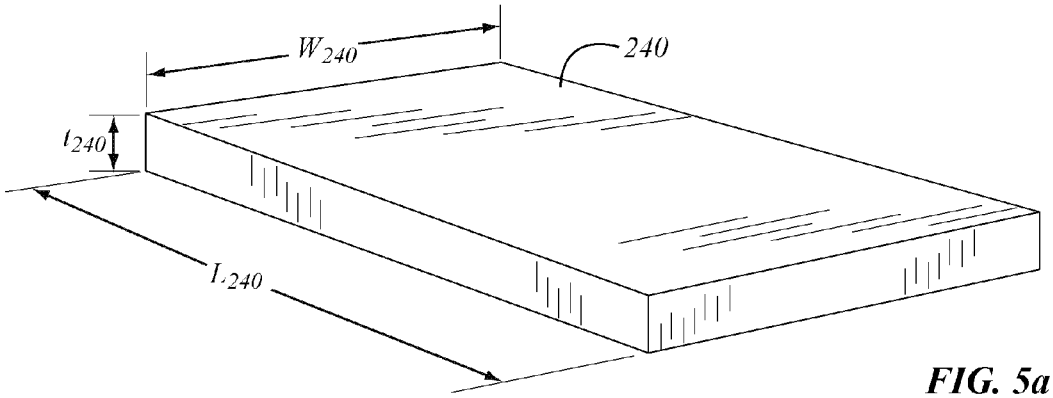

FIG. 5*a* shows a billet of insulation material for making a further embodiment of pre-fabricated insulation member different from that of FIG. 1*a;*

Figure 5B:
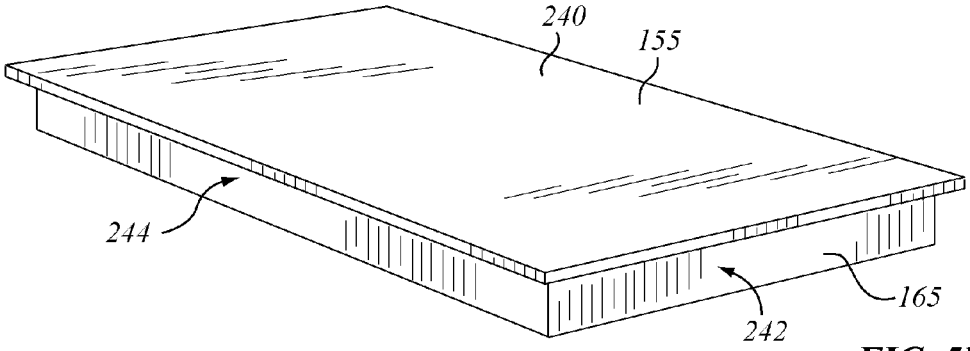
Figure 5C:
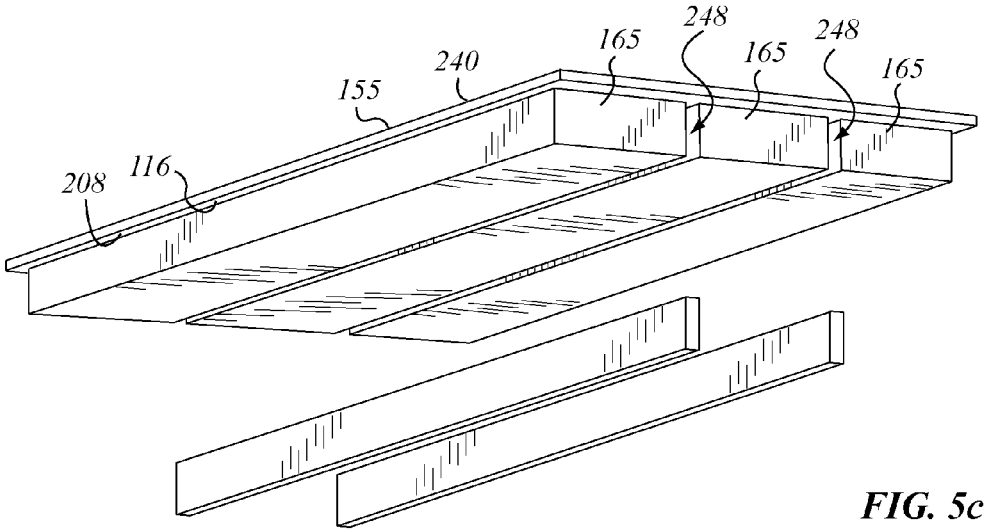
Figure 5D:
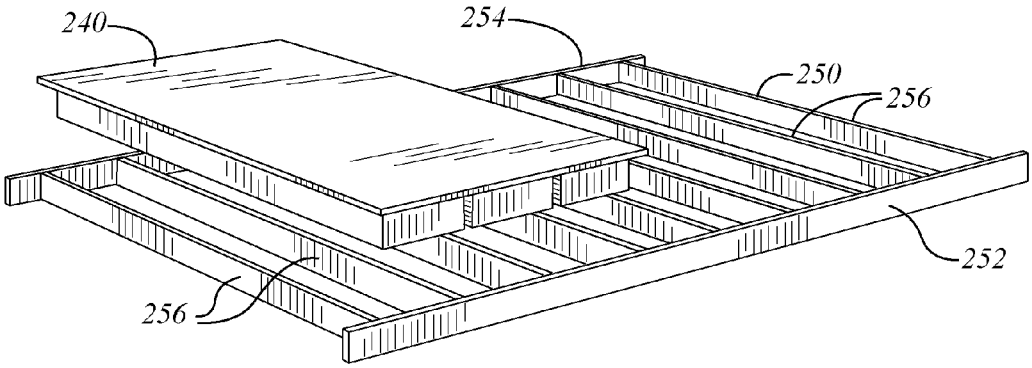
Figure 5E:
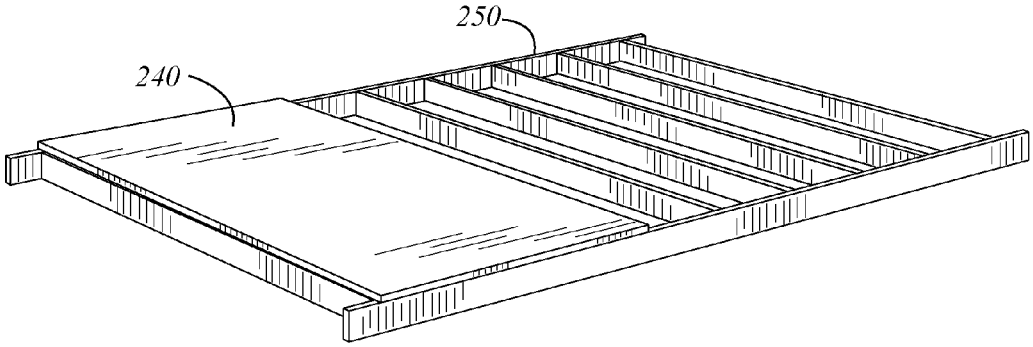
Figure 5F:
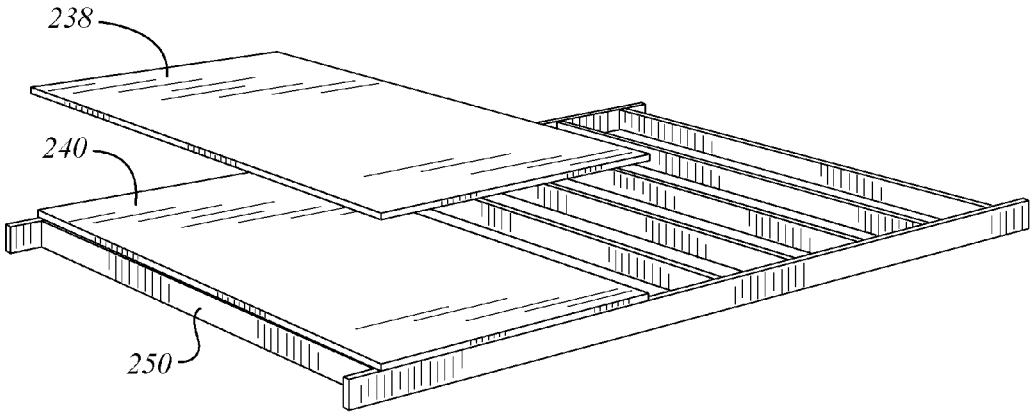

FIG. 5*b* shows the insulation material of FIG. 5*a* with sides and ends trimmed to accommodate studs and top and bottom plates;

FIG. 5*c* shows the billet of FIG. 5*b* formed to define intermediate stud accommodations;

FIG. 5*d* shows the insulation member of FIG. 5*c* position for engagement with a section of wall framing;

FIG. 5*e* shows the insulation member of FIG. 5*c* seated in the framing to form a modular wall sub-assembly;

FIG. 5*f* shows external sheathing positioned to mate with the sub-assembly of FIG. 5*e;*

Figure 5G:
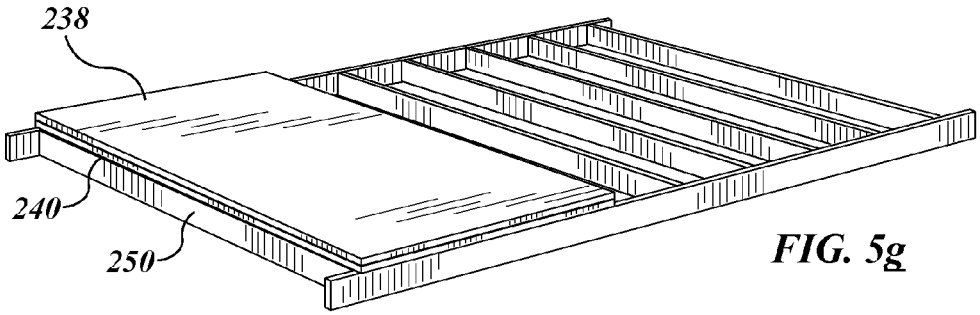
Figure 5H:
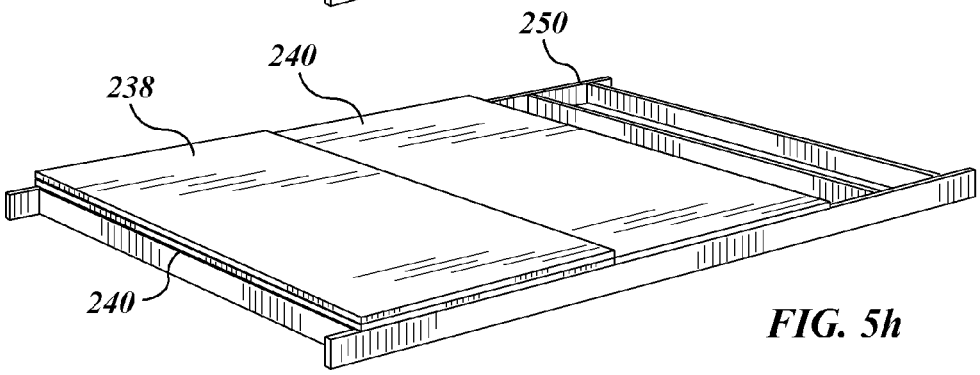

FIG. 5*g* show the sheathing of FIG. 5*f* mated to the sub-assembly;

FIG. 5*h* shows a next-adjacent insulated member seated in the wall framing of FIG. 5*d;*

Figure 5I:
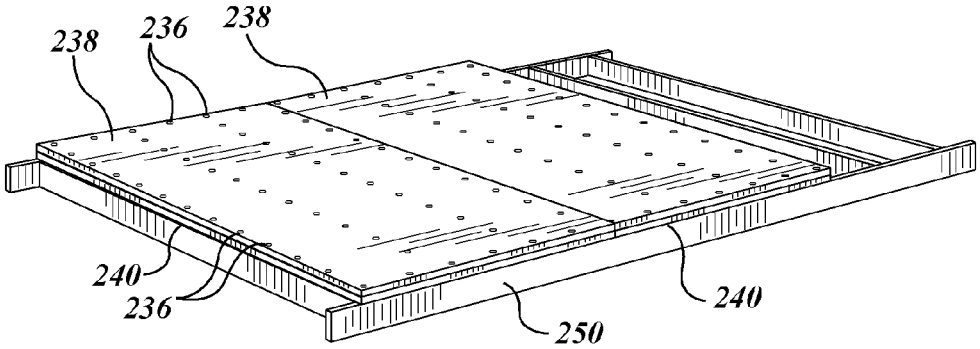

FIG. 5*i* shows external sheathing applied and fasteners installed to secure the framing assembly of FIGS. 5*d* to 5*h;*

Figure 5J:
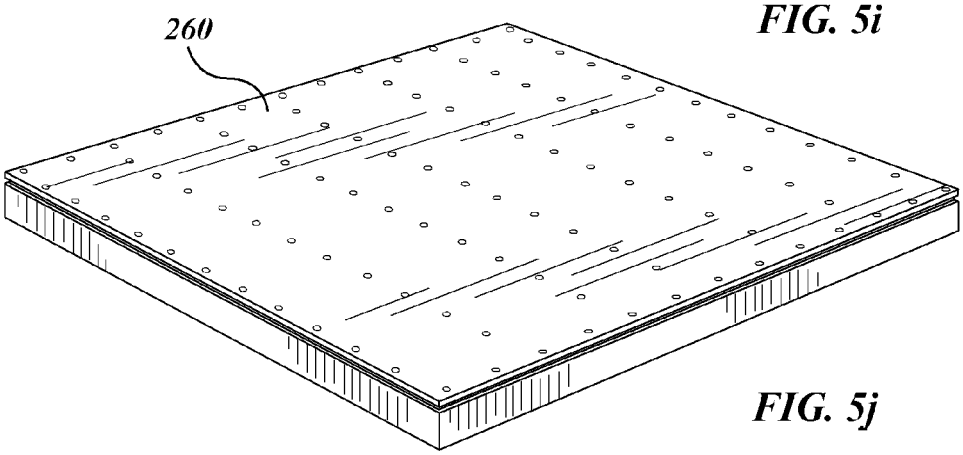
Figure 6:
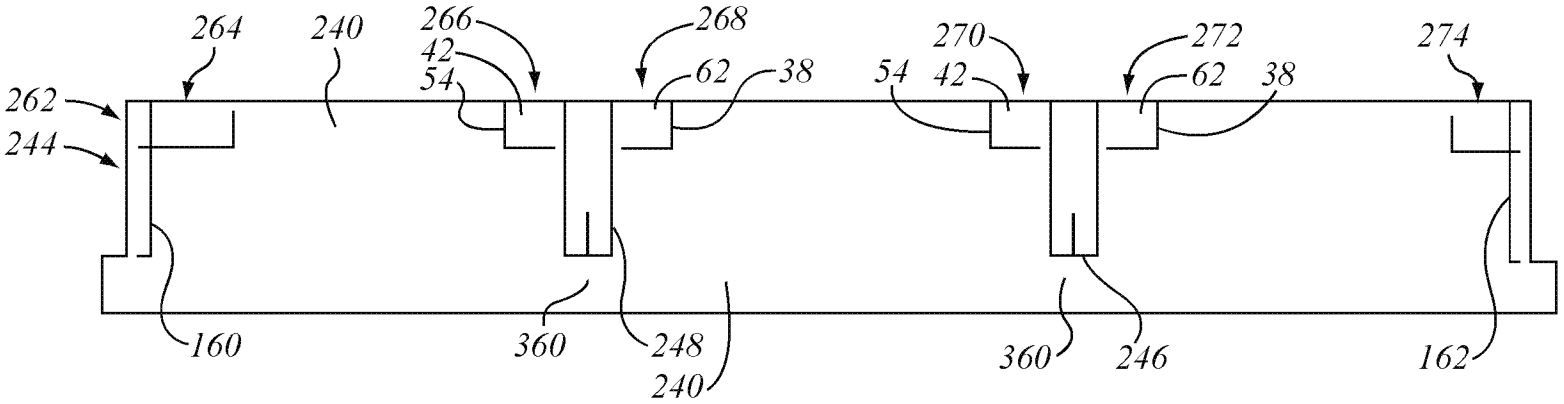
Figure 7A:
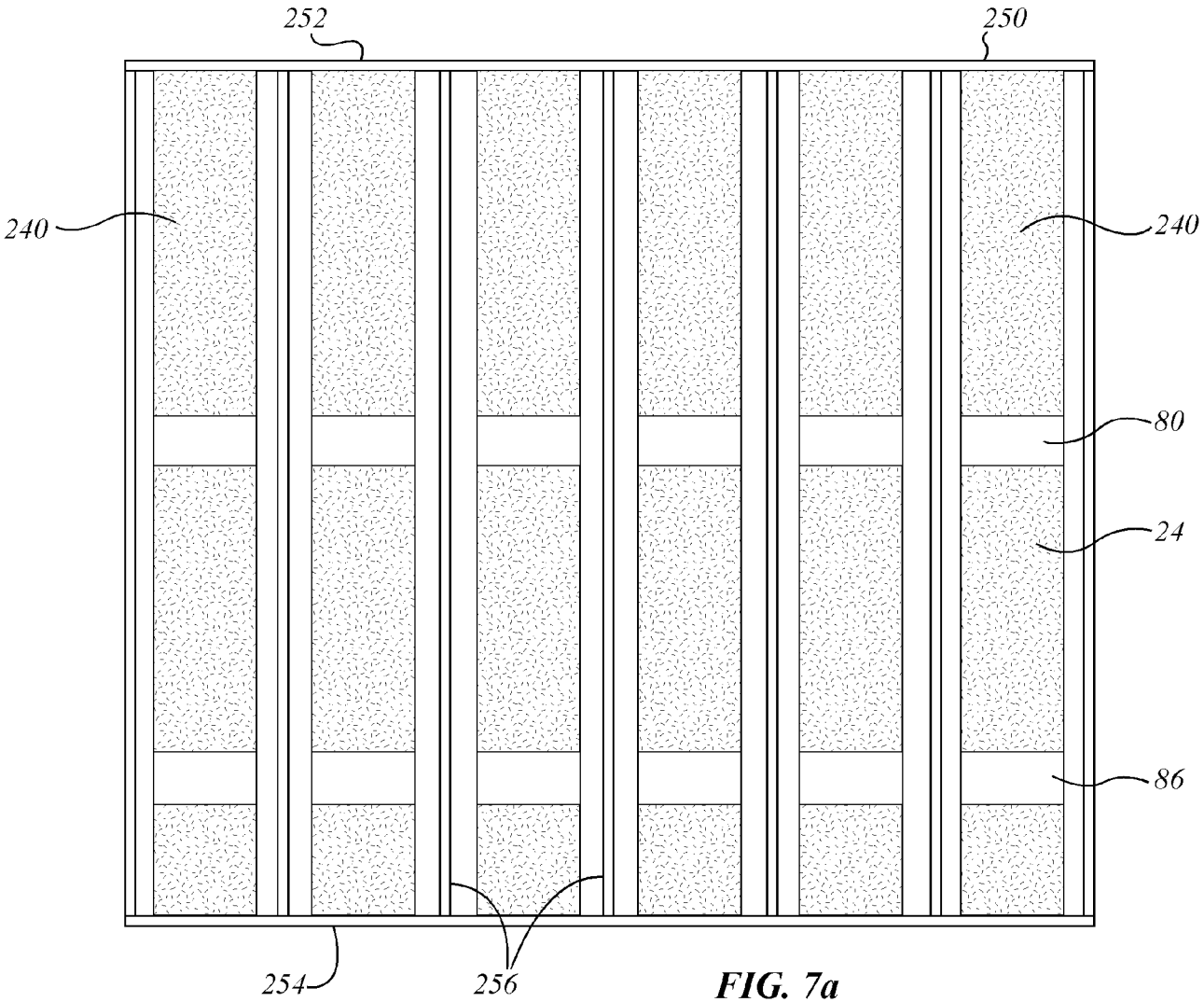
Figure 7B:
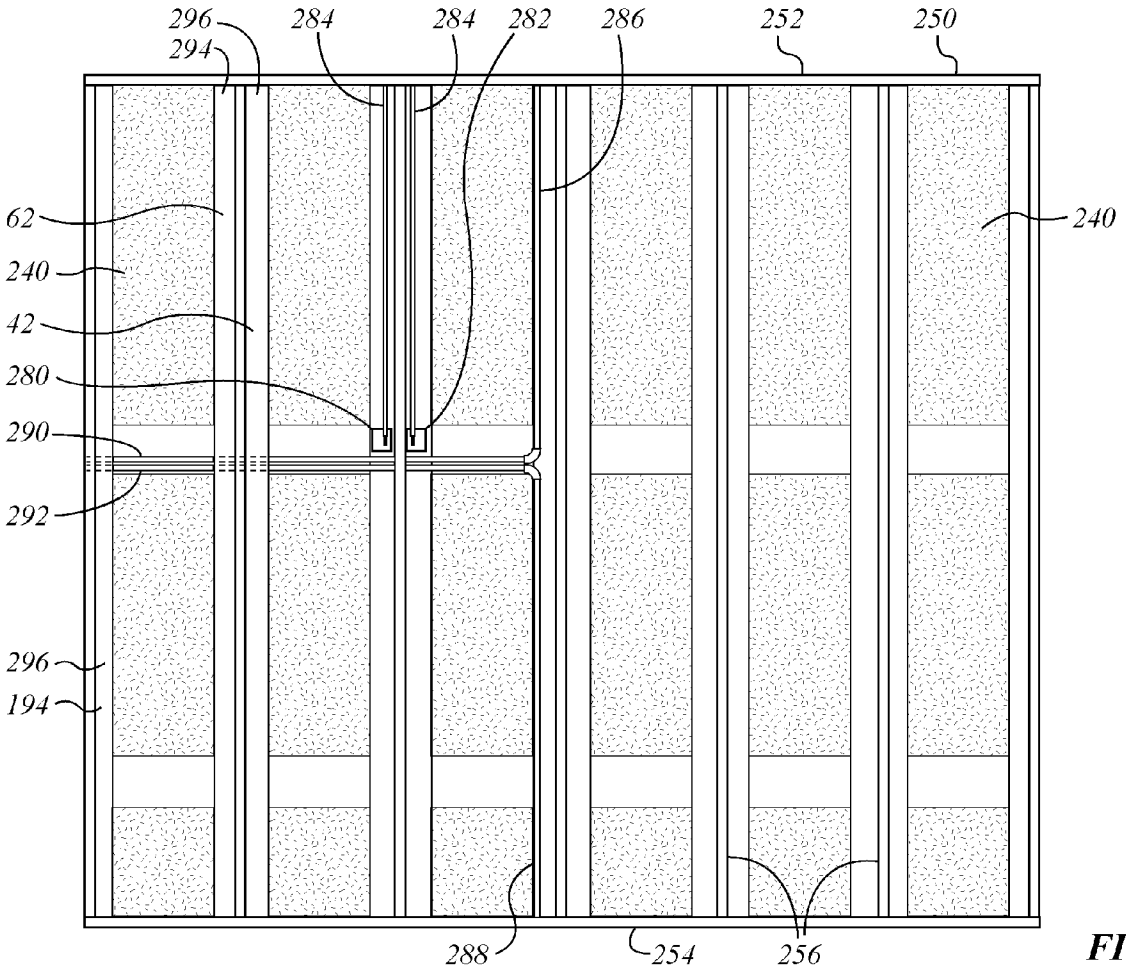
Figure 7C:
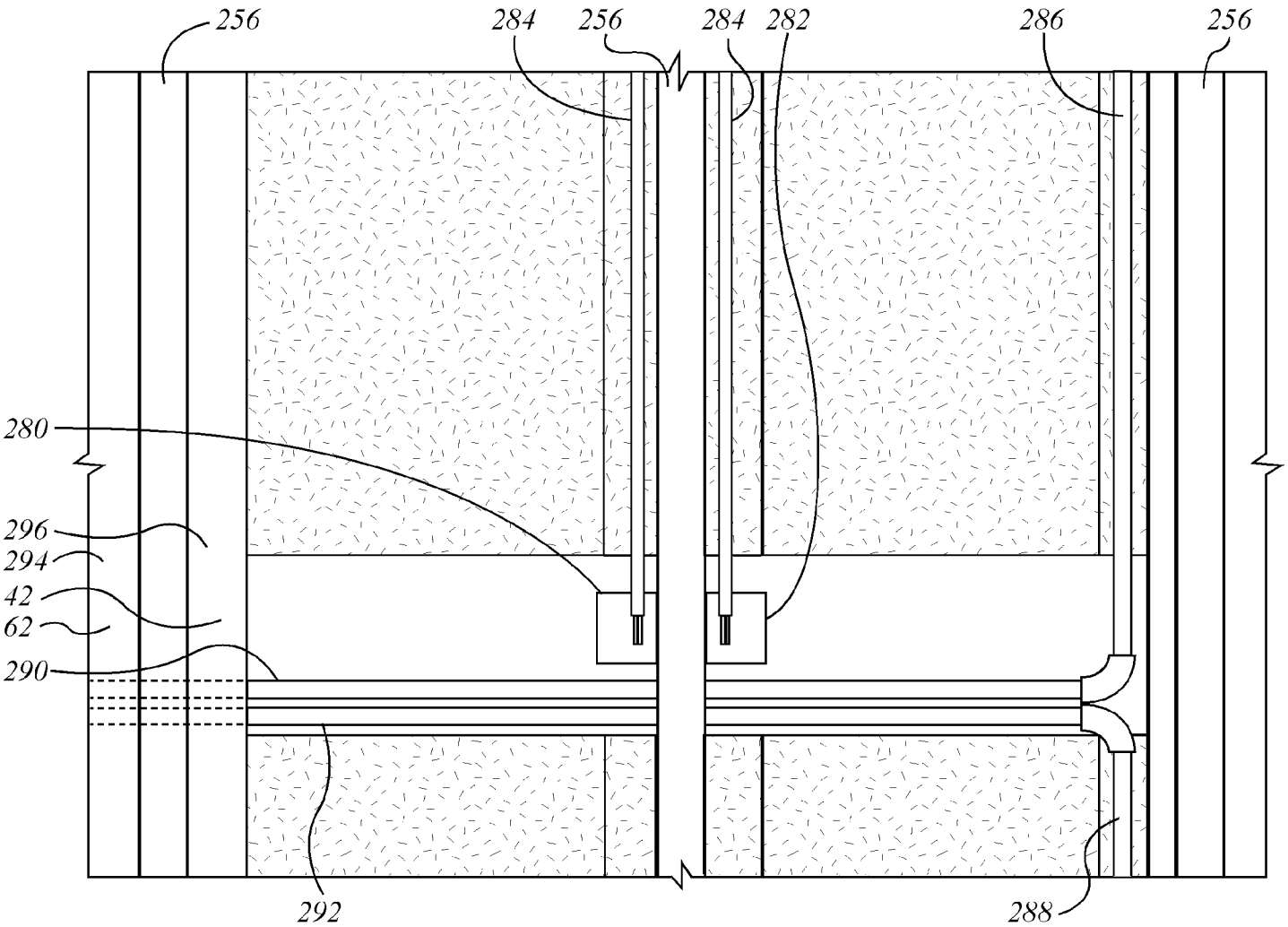

FIG. 5*j* shows a pre-fabricated modular wall in final form;

FIG. 6 shows a cross-section of the insulation member of FIG. 5*c* with cross-hatching omitted to show pre-formed accommodation cutting features;

FIG. 7*a* is a front view of the pre-fabricated wall of FIG. 5*j* with services access accommodation members removed;

FIG. 7*b* shows the front view of FIG. 7*a* with electrical and plumbing service members added;

FIG. 7*c* shows an enlarged view of a detail of FIG. 7*b*; and

Figure 8:
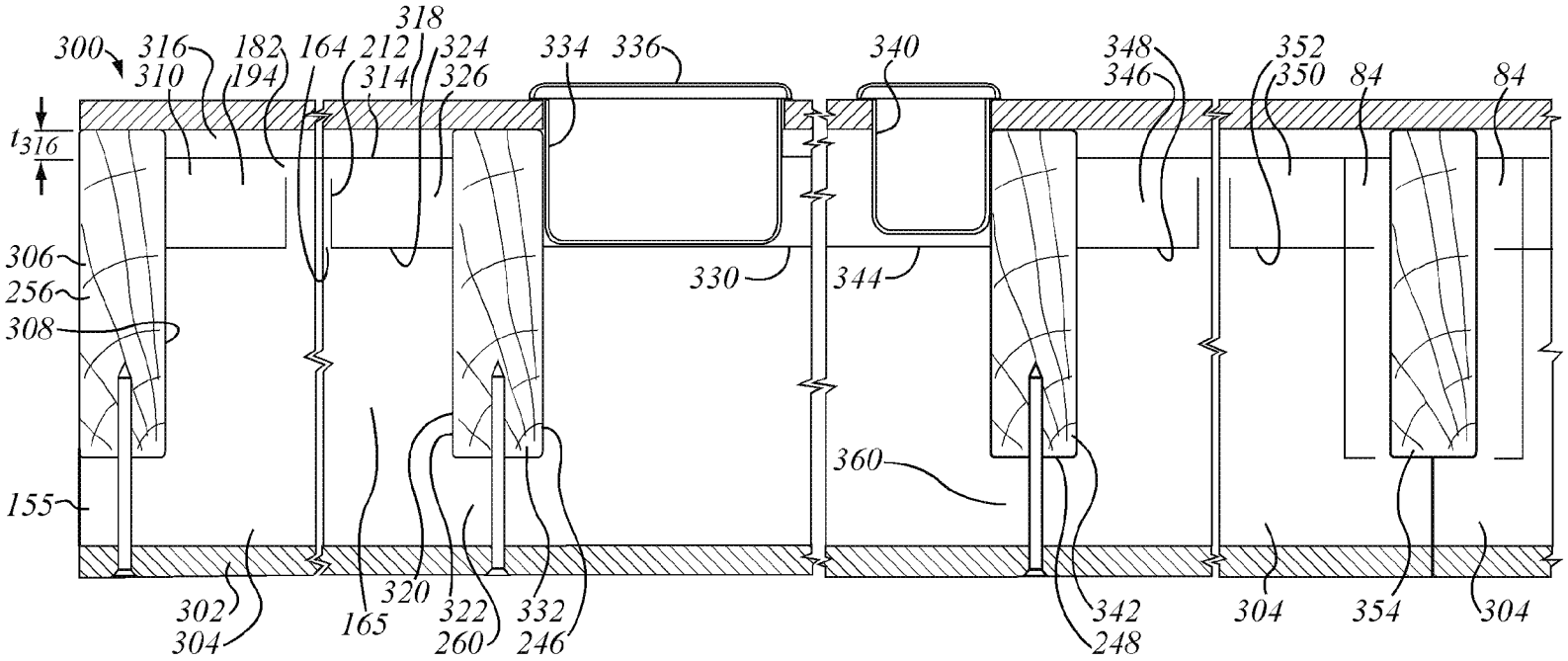

FIG. 8 shows a width-wise abridged embodiment of the pre-fabricated modular wall assembly of FIG. 5*j* with some services installed.

DETAILED DESCRIPTION

The description that follows, and the embodiments described therein, are provided by way of illustration of an example, or examples, of particular embodiments incorporating one or more of the principles, aspects and features of the present invention. These examples are provided for the purposes of explanation, and not of limitation, of those principles, aspects and features of the invention. In the description, like parts are marked throughout the specification and the drawings with the same respective reference numerals. The drawings may be taken as being to scale, or generally proportionate, unless indicated otherwise.

The scope of the invention herein is defined by the claims. Though the claims are supported by the description, they are not limited to any particular example or embodiment, and any claim may encompass processes or apparatus other than the specific examples described below. Other than as indicated in the claims themselves, the claims are not limited to apparatus or processes having all of the features of any one apparatus or process described below, or to features common to multiple or all of the apparatus described below. It is possible that an apparatus, feature, or process described below is not an embodiment of any claimed invention.

The terminology used in this specification is thought to be consistent with the customary and ordinary meanings of those terms as they would be understood by a person of ordinary skill in the art in North America. The Applicants expressly exclude all interpretations that are inconsistent with this specification, and, in particular, expressly exclude any interpretation of the claims or the language used in this specification such as may be made in the USPTO, or in any other Patent Office, other than those interpretations for which express support can be demonstrated in this specification or in objective evidence of record, demonstrating how the terms are used and understood by persons of ordinary skill in the art, or by way of expert evidence of a person or persons of experience in the art.

This description discusses modular wall assemblies and elements of such assemblies. In this discussion it may be helpful to make reference to a Cartesian co-ordinate system. In the embodiments described, the x-axis or a-direction may be taken as being the height or heighth-wise direction of the eventual assembly as assembled and installed in a building. In such installation the x-direction would most normally be a vertical axis, although insulation members and modular panels according to the invention need not be vertical but could be horizontal or inclined. The y-direction may be taken as the horizontal direction running along the wall width-wise. In the description, the major faces of the modular wall panels tend to be planar surfaces extending heighth-wise and width-wise in an x-y plane. The z-direction may be taken as the through-thickness direction of the wall panels and of their pre-fabricated insulation member components. This co-ordinate system assumes that the wall or wall module, or components thereof, is or are, viewed as finally installed. The terminology is nonetheless somewhat arbitrary and is understood whether the unit is installed in a vertical orientation, or is being processed in a factory in a horizontal or other orientation. The commonly used engineering terms "proud", "flush" and "shy" may be used herein to denote items that, respectively, protrude beyond an adjacent element, are level with an adjacent element, or do not extend as far as an adjacent element, the terms corresponding conceptually to the conditions of "greater than", "equal to" and "less than".

Reference is made herein to insulated members. For the purposes of this discussion a variety of commercially available thermal insulation materials could be used. Unless stated otherwise, the insulation members are made of expanded rigid foam, such as EPS (expanded polystyrene), although other foams could be used, and, subject to the needs of manufacturing processes, a less rigid material might also be employed in some instances.

Reference is made herein to framing that is assembled on standard centers or standard pitch spacing. The most common standard pitch spacings in North America are 12", 16", 19½" and 24" between centerlines of next-adjacent spaced apart studs. Although any such spacing may be used, in the embodiments shown and described herein a pitch spacing of 24" may be assumed. Other countries may have different standard dimensions. In the components and assemblies herein there may be axes of symmetry, and, unless otherwise noted, it may be understood that a description of one feature also provides a description of a symmetrical features, other than for being of opposite hand.

Reference is made herein to studs. In the context of framing, a stud is a member that extends vertically between a base or bottom of floor plate and a top plate, and that is most typically loaded in vertical compression. Studs may typically be made of construction grade softwood lumber, and less commonly of roll-formed steel sections. Studs may be of various standard sizes, most commonly nominal 2×4, 2×6, 2×8, 2×12 and 2×12. Where reference is made to an electrical box, or socket, it may be understood that such boxes or sockets or switches, or other fittings tend to be supplied in standard sizes. A box 4" high×1⅝ inches wide× 1½ inches deep is common, as are boxes 4" wide×4" high×1½ inches deep. Although deeper and wider enclosures are available, box and socket depths of 1½ inches or 2 inches are customary.

In this description provision is made for the accommodation of services. The term "services" is intended to be generic and is intended to include electrical fittings, including junction boxes, sockets, switches and conduit; and plumbing fittings, such as piping or drains, whether copper, pvc, or such other material as may be appropriate. It may also include other fittings, whether for telephone, home alarm, other communications or entertainment wiring and so on.

Referring to FIGS. 1*a*-1*e*, there is an insulation member designated generally as 20. It is generally rectangular in shape, having a length or height $L_{20}$ (indicated in the x-direction) and a width $W_{20}$ (indicated in the y-direction) and a through-thickness (indicated in the z-direction. The through thickness, $t_{20}$, is much smaller than either the height or the width. The height, $L_{20}$, may correspond generally to the height of a one storey wall of a building, such as a residential building, less the height for the floor plate and the top plate. I.e., the outside height dimension of the insulation corresponds to the inside height dimension between the floor plate and the top plate. For a nominally eight foot high wall, that resulting height dimension might be about 7 ft, 8⅝", and for a nominally nine foot high wall, that resultant height might be about 8 ft, 8⅝", for example. The width may correspond to the inside width between two adjacent studs in a wood-framed wall. Inasmuch as 2×4 or 2×6 studs may be spaced on 12", 16", 19.2" or 24" centers, and may be 1⅝" wide, in one embodiment such a width $W_{20}$ may be about 22⅜". In other embodiments $W_{20}$ may correspond to the appropriate width for 12" centers, 16" centers, or 19.2" centers, as may be. Through thickness $t_{20}$ may correspond to the depth of the studs in the y-direction, or may be somewhat less than the through thickness as discussed in respect of further embodiment hereinbelow.

Insulation member 20 has two major sides, being the outside face 22 and the inside face 24, extending in parallel, spaced apart x-y planes and defining what might be considered the front and back of the panel defined by insulation member 20. In the embodiment shown, outside face 22 and inside face 24 are both generally rectangular. Insulation member 20 also has four edge faces, being the bottom edge face 26, a top edge face 28, a first (or left-hand) side face 30 and a second (or right-hand) side face 32. In this embodiment, side faces 30 and 32 may be placed in engagement with, or immediately adjacent to the studs on either side in the eventual wall panel assembly. The fit may be a slight interference fit, such that the fit is reasonably snug. In this context, side faces 30 and 32 define first and second respective interfaces of the body of insulation member 20 and the adjacent studs.

It may be that, on installation, it is desired that the resultant wall panel, or wall panel module, may have services mounted therein, whether those services be electrical fittings, plumbing fittings, or otherwise. It may tend to be inconvenient to make accommodations for such fittings after-the-fact on the job-site. Insulation member has pre-fabricated provision for such accommodations. For example, insulation member 20 has a lengthwise running pre-cut (or slot, or notch, or incision, however it may be termed) 34 such as may be made with a hot wire at the factory, rather than on the job site. Pre-fabrication may provide opportunities for ease, efficiency and repeatability of fabrication, consistency and accuracy of standard dimensions such as may be difficult to achieve expeditiously on the job site with, for example, a knife or saw.

When seen in the view of FIG. 1*b*, looking parallel to the x-axis, pre-cut 34 has a first leg 36 running inwardly from first side face 30, and a second leg 38 running from the inner end of leg 36 toward inside face 24. First leg 36 may extend normal or perpendicular to first side face 30, and may extend generally parallel to inside face 24 for a distance $L_{36}$. Distance $L_{36}$ may, for example, correspond to the width of a 1½ inch wide electrical box such as might be used for a light switch or an electrical plug wall outlet socket. Second leg 38 extends toward inside face 24, and may extend generally perpendicular to inside face 24 in an x-z plane. It does not reach inside face 24, however, but rather terminates short thereof by a gap distance. Thus insulation member 20 has a first or main body portion, designated as 40, and a second portion 42, the first and second portions being joined at a neck 44. The width of neck 44, designated $t_{44}$, defines the gap distance between leg 38 and first side face 30. Insulation member 20 may be made of a substantially rigid eps (expanded polystrene) or xps (extruded polystyrene) foam. As such second portion 42 may be rotated about a vertical axis away from first portion 40, the bending motion tending to snap neck 44 such that portion 42 may come away as a strip of insulation, leaving an empty channel running in the heighth-wise direction, that channel having a width corresponding to first leg 36 and a depth $t_{60}$ corresponding to second leg 38 plus $t_{44}$. The location of various snap lines, at which one or another frangible neck may be intended to snap, is indicated in the various drawing views as an intermittent dashed line, or lines. The thickness of neck 44 may be less than ¼ inch, in some embodiments may be less than ⅛, and may in some embodiments be in the range of about 1/16 inch to 3/32 inches. The channel so formed may be termed, or may define, a service fitting accommodation 50 (which second portion 42 had formerly occupied) now open and exposed such as may facilitate the installation of service fitting such as electrical or plumbing fittings therein. Access to accommodation 50 is from the front (i.e., from the inside face of the wall as assembled), rather than requiring the installer to feed the fittings through a narrow, not necessarily easily accessible hole or bore in an end-wall. In the various pre-cuts shown, described and discussed herein, the resulting accommodation faces may tend to be planar or substantially planar, and may be cut with sharp 90 degree, right-angled corners. This need not necessarily be so—the planes could be oblique rather than perpendicular, the sides could be formed on curves whether of cylindrical or conical form, and the corners could be formed on corner radii, or be chamfered, rather than being cut square. However it may be convenient to use perpendicular cuts and square corners as shown.

In the event that no such fitting is to be installed, portion 42 may be left in place, with the inside face of portion 42, designated as 46, remaining as a generally co-planar portion or extension of inside face 24 more generally. In the event that the full heighth-wise extent of accommodation 50 is not required, an installer may either (a) snap out portion 42, cut it to length, e.g., with a knife, and then re-install the shortened cut remainder in the otherwise un-occupied portion of accommodation 50, thereby retaining the insulation value; or, alternatively, (b) the installer may use a marker on portion 42 prior to removal, and then cut along the mark, or marks, (presumably in the y-direction, inward from side face 30), and then rotate or snap the desired section (or sections) of portion 42 out, leaving exposed reliefs or rebates, or cavities, or chambers, as may be, to accommodate whichever service fitting is to be installed. The channel of accommodation 50 has substantially constant width and depth, may be sized for standard fittings, is easily accessible from the front (i.e., inside) face of the panel, and can be accessed merely by snapping out the blank, or filler member, otherwise defined by portion 42, or such part thereof as may be removed.

Similarly, a second incision, or slot, or pre-cut, 54 may be formed inwardly of second side face 32, with first and second pre-cut legs 56 and 58, to give an accommodation 60 on the opposite inside margin of insulation member 20 from accommodation 50, such the service fittings may be mounted to the studs along either side of insulation member 20. There may then be a third portion 62 of insulation member 20 that defines the blank or tab or filler that resides in accommodation 60 until such time as neck 52 is snapped and third portion 62 may be removed to permit the installation of services fittings, in like manner to that described above in respect of accommodation 50. Third portion 62 may be taken as being the same as second portion 42, but of opposite hand.

In either case, the service fitting accommodation is located immediately adjacent to the stud (i.e., running alongside a stud engagement interface of insulation member 20), which is the most probable location for a light switch, plug, junction box of plumbing fitting, given that those fitting are most often secured by nails or screws or cleats to the stud.

It may be that a services channel, or channels, or access accommodation, may be desired that run cross-wise to insulation member 20. To that end, insulation panel may have a third pre-cut 64 extending inwardly into from inside face 24. Pre-cut 64 may have a first leg 66 extending in a y-z plane perpendicular to inside face 24, a second leg 68, which may extend from first leg 66 in an x-y plane generally parallel to inside face 24, and a third leg 70 which may extend from second leg 68 back toward inside face 24, defining a fourth portion 72 connected to first portion 40 at a neck 74. In generally similar manner to second portion 42 and third portion 62, fourth portion 72 may be rotated about the y-axis to snap neck 74, thereby revealing a cavity or chamber of lateral channel, identified as services fitting accommodation 80. As with accommodations 50 and 60, an installer need not remove all of fourth portion 72, but may remove such part thereof as may be appropriate, or may reinstall a cut remainder thereof in such portion of accommodation 80 as may not be occupied by services fittings.

Third pre-cut 64 may be at a height $x_{80}$ suitable for the installation of wall switches, and may, in one embodiment, have a bottom edge 50 inches from the floor, and may be six inches in vertical extent $L_{80}$ as installed (i.e., ranging from 50 to 56 inches above the floor). In addition, insulation panel 20 may have a fourth pre-cut, 84 having corresponding legs 66, 68 and 70, being generally the same as pre-cut 64, but located closer to floor level, as at a bottom edge of 14 inches above floor level (ranging from 14 inches to 20 inches above floor level) such as to provide a lower laterally (i.e., width-wise) extending service fitting accommodation 86, and frangibly removable portion 88 which may be termed a tab, blank, or filler, as may be.

With the embodiment of FIGS. 1*a*-1*e* in mind, the embodiment of FIGS. 2*a*-2*e* adds a further feature or step of complexity. That is, rather than having a total through-thickness $t_{20}$ that is less than or equal to the through thickness of the studs with which insulated member 20 may be intended to be used, insulated member 120 may have a greater overall through-thickness $t_{120}$. For example, it may be desired that there be a layer of insulation between the studs and the outside sheathing of the wall member or module, such as may reduce thermal bridging in the x-direction. In one embodiment, of course, insulated member 20 may be used, and then another insulated member, such as a nominally 1 in. or 2 in. (or thicker, as may be) sheet, whether 2 ft×8 ft, or 32"×96", or 4 ft×8 ft., may be mounted to the outside face of the studs, while insulation members 20 are mounted between the studs, or, alternatively, insulation members 20 may be adhesively (or otherwise) mounted to an exterior backing sheet of insulation, whether of the same type or different, by pre-fabrication at the factory.

Further still, where insulation member 20 is of a certain through thickness, such as may be suitable for use with studs of through thickness x, yet is supplied where the actual stud dimension is x+2 inches or x+4 inches. In such instance, insulation member 20 may be used as the inside layer, one or more layers of 1 inch or 2 inch thickness and a width to seat between studs spaced on the applicable stud center distance may be used behind insulation member 20, and then an external sheet of the desired thickness may be applied outside the studs. Such a laminate can be assembled on site, or, alternatively, may be assembled at the factory as a pre-fabricated assembly or module.

However, rather than building up a laminate of a plurality of co-operating insulation members, insulated member 120 of FIGS. 2*a*-2*e* may be pre-fabricated from a single monolith of material stock. The monolith has an outside face 122 and an inside face 124, extending in parallel, spaced-apart x-y planes, as before. The bottom, top, first and second side faces are designated as 126, 128, 130, and 132, respectively. Bottom face 126 has been trimmed, as with a hot wire, to create a cavity, or space, or accommodation, 134, which conforms to a top plate of the wall assembly, and top face 128 has a corresponding floor plate accommodation 136. Similarly accommodations 138, 140 are formed in first and second side faces 130, 132 for accommodating spaced apart studs of the framing. The hollow, or cavity, or relief, or rebate, or accommodation 138 or 140 so formed may be termed a stud interface, or stud interface fitting. Viewed alternately, once trimmed, insulation member 120 is left with outside face top, bottom, first side edge and second side edge flanges, respectively 142, 144, 146, and 148, that form a peripherally extending shoulder, abutment, or stop, and that, as installed, seat outside and against the top plate, floor plate and studs respectively. It may be that the width $W_{138}$ of accommodations 138 and 140 are half the width of a stud (i.e., half of 1⅝ inches), such that the installation of two adjacent insulation members 120 will yield respective mating flange halves covering the stud between them.

The remaining features of insulated member 120 may be taken as being the same as the features of insulated member 20 previously described, including the services panel accommodations and frangible tabs or blanks. As may be noted, the flanged face is thus the outside face 122, and the inside face is the face 124 from which or by which the services channels or accommodations are accessible.

The shoulder 118 formed by the flanges 142-148 also defines a locating datum for insulated member 120 more generally, that datum being located in a parallel x-y plane spaced from and intermediate to the planes of outside face 122 and inside face 124. That is, whatever the overall through thickness $t_{120}$ of insulated member 120 may be, the inside face of the flanges, namely shoulder 118, define a stop or abutment, or index, that will locate against the outside face of the studs, top plate and floor plate. The flange thickness $t_{148}$ may be set by the manufacturer to correspond to an appropriate external insulation thickness between the studs and the external sheathing. Similarly, the thickness of the inserted portion, $t_{140}$, lying inwardly of the flange datum may also be set by the manufacturer. The thickness, $t_{140}$ may be the same as the stud width, or in some embodiments it may be less than the stud width so that the studs, on installation, may extend slightly proud of inside face 124, such that when internal sheathing, such as gypsum board, is applied there may be a clearance space between the gypsum board and inside face 124. That clearance space, of which an example is shown in FIG. 8, may be of sufficient depth in the thickness direction to accommodate, for example, electrical wiring.

In the embodiment of FIGS. 3*a* and 3*b*, there is an insulated member 150 which is substantially similar to insulated member 120. However, it may occur that at the end of a wall module or wall portion, the last stud may be positioned not on the full center spacing, but rather so that the most distant face of the stud is on the spacing. That is, supposing that a module is 48" wide and 96" tall, and the studs are on nominal 12", 16", 19.2" or 24" centers. At the edges of the sheet, the side-most stud will be half on the sheet, and half off the sheet. If the module is in the middle of a longer wall, then the end stud is half covered by the insulation flange of one module, and half covered by the insulation flange of the next adjacent module. If, however, that module is the end module of the wall, then the stud needs to be moved over half its width such that the laterally outside face of the stud lies in a plane flush with the edge of the 48"×96" external sheathing sheet.

To address that possibility, insulation member 150 has a main body portion 152 which includes the various peripheral flange members, designated collectively as 154. Along the first and second side edges or side margins 156, 158 of main body portion 152 are incisions, or slots, or notches or pre-cuts 160, 162 that extend into insulation member 150 from inside face 164. Pre-cuts 160 and 162 are the same but of opposite hand.

Pre-cut 160 has a first portion, or first leg, 170 that may extend in an x-z plane from inside face 164 to a level flush with the abutment face 166 (i.e., the flange shoulder datum) of the top plate and floor plate portions 142, 144 of flange 154. First leg 170 may be inset laterally from side face 168 a distance $W_{170}$ corresponding to half the width of the stud size with which insulation member 150 is to be used. Side face 168 may itself be offset ½ of the width of the stud from the outside edge of flange 154, that distance being indicated as $W_{168}$. Pre-cut 160 also has a second portion or second leg 172 being a lateral leg, which may extend in a plane parallel to inside face 164. Second leg 172 may be inset from inside face 164 the same distance as is leg 36, namely $t_{50}$ a distance corresponding to a standard service fitting depth relative to the ultimate inside face of the drywall sheet that may be mounted to the inside face of the stud. In one embodiment that distance may be set to suit the depth of a 1½ inch box, a 2 inch box, or a 2½ inch box, where a 2.5 inch box depth will, of course, also accommodate shallower boxes or fittings. Second leg 172 may have a first part 174 that extends from first leg 170 away from side face 168, and a second part 176 that extends from first leg 170 toward side face 168, leaving an uncut frangible neck 178. At the other end of second leg 172 is a third leg, 180 which extends back therefrom toward inside face 164 leaving a frangible neck 182. At the innermost end of first leg 170 is a fourth leg 184 extending outwardly toward end side face 168, level with shoulder 166 but stopping short to leave a frangible neck 186.

When insulation member 150 is installed in a mid-wall position, and no service fittings are to be installed, none of the removable tabs or blanks are removed. When insulation member 150 is an end panel, the finger 188 defined between first leg 170 of pre-cut 160 and first side face 168 is removed, making the accommodation lying forward of flange 146 have sufficient width to accommodate the full thickness of the stud. When insulation member 150 is in a mid-wall position, and a service fitting is to be placed next to, or to run vertically alongside of, the stud, then the distal tip portion 190 of finger 188 is removed by snapping frangible neck 178, and leaving proximal portion 192 of finger 188 in place. The inboard portion of the service fitting accommodation is then exposed by snapping frangible neck 182 and removing strip 194. Insulation member 150 may also have provision for lateral, or width-wise, service fitting accommodations 80 and 86 in the same manner as insulated members 20 and 120, as previously described.

In summary, in the embodiment of FIGS. 3*a* and 3*b* insulation member 150 is pre-fabricated from a block of insulation that has been trimmed with a hot wire to define a set of accommodations for wall framing members along top, bottom, left and right margins. Main body 152 has two major portions, those being the flanged portion 155 lying to the outside of the datum defined by shoulder 118, or 166 as may be, and the main "plug" of body 152, identified as 165. Plug 165 conforms to the generally rectangular shape of, and seats within, the generally rectangular openings or bays defined by the top and bottom plates and the various spaced-apart studs of the framing, thereby filling, or substantially filling, with insulation the otherwise empty cavity in the framing. The lateral margins of plug 165 also have three parts or portions, those being the removable, frangible portions defined by items 190, 192 and 194. The laterally extending service fitting accommodation blanks (i.e., 72, 88) also define frangible, removable portions.

In the embodiment of FIGS. 4*a* and 4*b*, there is an insulation member 200 that is pre-fabricated from a stock monolith having the width of at least two pitches of a framed wall. The first and second outside margins 202, 204 may be as described in the context of the lateral or outside margins of insulation member 150 of the embodiment of FIGS. 3*a* and 3*b*. Insulation member 200 also has a central relief, or rebate, or chase, or channel, identified as stud accommodation or stud channel 210 which is of a width corresponding to the thickness of a stud, and of a depth $t_{210}$ from inside face 206 to flange abutment face 208 (or 118 or 166, as may be) that is equal to or greater than the stud width, as previously discussed.

On left and right hand sides of stud channel 210 are service fitting accommodation incisions 212, 214 each having a first leg 216 extending into the body of insulation member 200 from inside face 206, and a second leg 218 extending from the inner end of leg 216 toward stud channel 210, leaving a frangible neck 220. As previously explained, when service fittings are to be installed, the tab or blank, or filler portion 222 is removed by snapping neck 220, revealing first or second (L or R) service fitting accommodation 224 or 226 as may be. The lead-in corners of stud channel 210 may be radiused or chamfered, as at 228 to ease installation. As with insulation members 150, 120 and 20, insulation member 200 may also have laterally or cross-wise extending service fitting accommodations 80 and 86 formed ready-to-be-opened in front face 206.

FIGS. 5*a*-5*j* show a progression of steps in the manufacture and assembly of an insulated wall panel and module. Insulation member 240 may be made from a monolithic block of insulation 48" wide ($W_{240}$)×96" high ($L_{240}$), with a through-thickness ($t_{240}$) such as may suit the studs and other assembly members with which it is to co-operate. In a first step of manufacture in FIG. 5*b*, cuts are made to trim out accommodations for the top plate and floor plate as at 242, and for the outside studs, as at 244. In this sequence of operations, cuts and incisions may have been made with a hot wire. As shown in FIG. 5*c*, further incisions are made, as with a hot wire, for example, to form spaced-apart stud channels 246 and 248, which, in the instance of a 48" wide member may be spaced on 16" centers. As shown, insulation member 240 is suitable for mating engagement with the elements of a framed wall structure 250, be it of wood-framed or roll-formed steel structural elements. As can be seen in FIG. 5*d*, framed wall structure 250 includes a top plate 252, a floor plate 254 and studs 256 that run perpendicular to, between and in fastened connection with, top plate 252 and floor plate 254. It may be noted that while a single 2×6 may be used for the floor plate, it is customary for the top plate to be doubled. Thus the cut out 242 made for the floor plate may be 1½", the insulation plug for filling the cavity between the studs is 92⅝, and the cut-out 242 made for the top plate defines a flange width corresponding to the remainder of the 96" dimension of the monolith of the stock material, roughly 1⅞ inches.

In FIG. 5*e* insulation member 240 is seated in mating engagement with framed wall structure 250, with the datum shoulder of the peripheral flange members 154 in abutting relationship with the outside faces of the respective members of framed wall structure 250. A panel of exterior sheeting 238 is then mated to outside face 258 of member 240 as in FIGS. 5*f* and 5*g*. In FIG. 5*h* another insulation member 240 is seated in the next adjacent series of bays of wall structure 250, in side-by-side fashion, and another panel of external sheeting 238 is put in place. Fasteners 236, such as nails or screws, are then driven through sheeting 238 and the outer portion of insulation of insulation member 240 into studs 256. A finished pre-fabricated panel module 260 is shown in FIG. 5*j*.

FIG. 6 shows the cuts or incisions made in insulation member 240 prior to assembly such as to provide the various fingers, tabs and frangible necks to define two-position edge stud widths as at 262 in the manner explained in the context of FIGS. 3*a* and 3*b*; and to define inner-face-accessible service fitting accommodations 264, 266, 268, 270, 272, and 274, all as previously described in the context of FIGS. 3*a* and 3*b* (264 and 274) and of FIGS. 4*a* and 4*b* (266, 268, 270, and 272). As with insulation members 20, 120, 150, and 200, insulation member 240 may also have provision for laterally extending service fitting accommodations 80 and 86 as previously described.

FIGS. 7*a*-7*c* show a progression of installation of service fittings in finished module 260. FIG. 7*a* shows module 260 with all tabs, blanks and fillers removed to expose vertical and lateral service accommodations (224, 226 vertical, adjacent to studs 256; 80, 86 upper and lower laterals running between adjacent stud pairs). Channels 224, 226 are of a width to permit nails or other fasteners to be driven through the floor plate or top plate for attaching them to other structure, such as a sub-floor and joists.

In FIG. 7*b*, electrical sockets have been installed as at 280, 282, and wiring 284 drawn to the sockets down from top plate 252. Plumbing fittings have also been installed, as indicated at 286, 288, 290 and 292, with bores having been made through successive joists 256. FIG. 7*b* shows a larger detail of the fitting installation. Removable members are reinstalled, or remain in, the unused service fitting accommodations, as indicated at 294, 296.

FIG. 8 shows an enlarged detail of a cross-section of a fully assembled wall structure 300, laterally abbreviated, showing the relationship of the various items as installed. The outside wall sheeting 302 is at the bottom of the view. Sheeting 302 is mated to insulation member 304 which may be representative of any of insulation members 150, 200 or 240. An end stud 306 is seated in, or mates with the side edge interface defined by end accommodation 308 of insulation member 304, from which a finger 184 has previously been removed. The inner portion of the service fitting accommodation filler strip 310 remains in place as no service fitting is located next to end stud 306.

Inside end 312 of end stud 306 stands inwardly proud of inside face 314 of insulation member 304, leaving an air gap 316 of thickness $t_{316}$ between inside face 314 and the back of the inside finishing cover member, identified as gypsum board 318. In a bay to the right, an opposed or second side face or side edge interface 320 of insulation member 304 is defined by the left wall of the vertical stiffener accommodation identified as stud channel 322. To the left of stud channel 322, the vertical service fitting accommodation 324 is unused, and remains occupied by the tab or filler or blank 326. The section in this part of the illustration is taken at a height on wall structure 300 corresponding to a lateral service fitting chase or channel or accommodation 80. On the right hand side of intermediate stud 332 is a service fitting enclosure, in this instance an electrical junction box 334 such as may house a socket or switch, or both, the internal wall cover plate being indicated as 336. Box 334 seats in the vacated lateral accommodation 330, across which wiring may extend to electrical outlet enclosure box 340 which is mounted to the next adjacent intermediate stud 342, the vertical filler strip having been removed from accommodation 344. On the right hand side of intermediate stud 342 the filler strip 346 remains in unused accommodation 348, as does filler strip 350 in accommodation 352. Here, since the next stud to the right, 354, is a normal intermediate stud half overlapped on each side by insulation member 304, and half-overlapped on the other side by next adjacent insulation member 356 of the next wall module, fingers 84 remain in place, and stud 354 seats against the right hand stud interface of insulation member 304. The various studs are secured in the stud engagement interfaces or seats or channels by mechanical fasteners, such as nails, driven through outside sheeting 302 and through the channel back portion 360 of insulation member 304 of thickness corresponding to the outside face peripheral flange thickness. To the extent that the internal wall cladding, be it gypsum board or otherwise, may be ½ inch thick, or thicker, and the air gap is ⅜ to ½ inch, the service fitting accommodation may be ¾" deep or deeper to accommodate 1½ inch deep fittings.

The methods of manufacture and assembly described above presume the pre-existence of the assembled framing members, into which the pre-fabricated insulation members are then placed into the pre-constructed framing. However, both eps and xps are quite stiff, and insulation members such as insulation member 20, 120, 150, 200, insulation member 240 or insulation member 304 may be prefabricated, and may then themselves function as jigs in or with which to build up the framing of the modules, whether on the job site, or, perhaps more efficiently, in a factory in which many panels can be assembled.

Several embodiments have been described hereinabove. Further embodiments can be made combining the features and aspects of those embodiments in such combinations and permutations as may be appropriate, as may be understood without need for redundant explanation of further description of all of those possible combinations and permutations.

What has been described above has been intended illustrative and non-limiting and it will be understood by persons skilled in the art that other variances and modifications may be made without departing from the scope of the disclosure as defined in the claims appended hereto. Various embodiments of the invention have been described in detail. Since changes in and or additions to the above-described best mode may be made without departing from the nature, spirit or scope of the invention, the invention is not to be limited to those details but only by the appended claims.

I claim:

1. An insulation member for a wall construction in which the insulation member co-operates with an array of wall framing studs, said insulation member comprising:

a body having a height, a width and a depth;

said body having defined therein at least a first stud accommodation in which to seat a first stud, and a second stud accommodation in which to seat a second stud, said first and second stud accommodations being spaced width-wise apart from each other, and running height-wise; said body having a first face and a second face;

a first insulation blank, said first insulation blank extending along said first face and being frangibly connected to said body;

said first insulation blank being removable from said body to expose a first service accommodation defined in said body;

said first service accommodation sharing a common side with said first stud accommodation, and having a length, a width, and a depth, said length being greater than each of said width and said depth, said length running along said first face, said depth extending into said body away from said first face; and when said first insulation blank has been removed, said first service accommodation being open along said length thereof, whereby said first service accommodation has access from said first face to permit a service member to be laid side-ways into said first service accommodation.

2. The insulation member of claim 1 wherein said body includes an accommodation for at least one of (a) a head plate; and (b) a foot plate.

3. The insulation member of claim 1 wherein said first service accommodation runs height-wise along said first stud accommodation.

4. The insulation member of claim 1 wherein a second service accommodation is located adjacent to said second stud accommodation.

5. The insulation member of claim 4 wherein said first service accommodation runs height-wise along said first stud accommodation, and said second service accommodation runs height-wise along said second stud accommodation.

6. The insulation member of claim 1 wherein said first service accommodation extends width-wise between said first and second stud accommodations.

7. The insulation member of claim 6 wherein a second service accommodation extends width-wise between said first and second stud accommodations.

8. The insulation member of claim 1, the first stud accommodation being formed to engage a stud having a short side and a long side, wherein said first service accommodation is formed to admit the stud with the short side of the stud parallel to said first face, and said first service accommodation is shallower than said first stud accommodation.

9. The insulation member of claim 1 wherein said first service accommodation is at least 34 inches deep.

10. The insulation member of claim 1, wherein:

said first face and said second face are an inside face and an outside face respectively;

said first and second stud accommodations are shallower than said depth of said body, and are open toward said inside face;

said first service accommodation is beside said first stud accommodation, and is located between said first and second stud accommodations.

11. An insulation member haying a height, a width, and a through thickness, said through-thickness being smaller than either of said height and said width, said insulation member having:

a first body portion for installation between spaced-apart first and second wall studs; said first body portion having a first face, said first face extending height-wise and width-wise;

a second body portion frangibly connected to said first body portion;

said second body portion being disconnectible and removable from said first body portion to expose a first service accommodation pre-defined in said first body portion, as installed said first service accommodation having a side bounded by the first stud;

said first service accommodation having a length, a depth, and a width, said length being greater than each of said depth and said width, said length running along said first face, said depth extending from said first face into said first body portion;

and with said second body portion removed, said first service accommodation being accessible along said length thereof from said first face, whereby a service fitting can be laid sideways into said first service accommodation from said first face.

12. The insulation member of claim 11 wherein said insulation member has a first stud interface; and said first service accommodation runs beside said first stud interface.

13. The insulation member of claim 11 wherein said insulation member has a first stud interface and a second stud interface, and said first service accommodation runs width-wise across said first body portion between said first and second stud interfaces.

14. The insulation member of claim 11 wherein said insulation member has a first stud interface and a second stud interface, said first service accommodation runs along said first stud interface, and said insulation member has a second service accommodation running along said second stud interface; said second service accommodation being accessible from said first face.

15. The insulation member of claim 11 wherein said first body portion has a first stud interface and a second stud interface; said insulation member also includes a second service accommodation; said first service accommodation runs predominantly height-wise along said first stud interface; and said second service accommodation runs width-wise between said first stud interface and said second stud interface.

16. The insulation member of claim 15 wherein said first body portion has a third service accommodation; said third service accommodation running along said second stud interface; and said third service accommodation being accessible from said first face.

17. The insulation member of claim 11 wherein:

said insulation member also has one of (a) another service accommodation running lengthwise along, and being accessible from, said first face;

(b) another service accommodation running width-wise across, and being accessible from, said first face; and (c) both (a) and (b); and said insulation member includes a third body portion, said third body portion being frangibly connected to said first body portion, and said third body portion fitting within any said service accommodation other than said first service accommodation; said frangible third body portion being removable from the other service accommodation.

18. The insulation member of claim 11 wherein said second body portion is a frangible blank that occupies said first service accommodation.

19. The insulation member of claim 18 wherein said first body portion and said frangible blank are parts of a single insulation monolith.

20. The insulation member of claim 11 wherein said first service accommodation is shallower than said through-thickness of said first body portion.

21. A combination of an insulation member for a wall construction and framing members of the wall construction, the framing members including at least first and second spaced-apart studs and a cavity formed therebetween, the wall construction having a height, a width, and a through-thickness, the studs having a thickness and a width, the cavity having a depth in the through-thickness direction of the wall construction; said insulation member defines a plug for the cavity; said, plug: is shorter in the through-thickness direction than the depth of the cavity;

and said plug has at least one frangible blank that is removable to expose a corresponding at least one pre-formed service fitting accommodation defined therein running along and having a side bounded by said first stud, said service fitting accommodation having a length, a width and a depth, said length being greater than each of said width and said depth; said wall construction has an inside and an outside, said studs stand proud of said plug toward said inside of said wall construction, said length of said service fitting accommodation runs along said inside of said wall construction, said depth of said service fitting accommodation extends from said inside of said wall construction into said plug; and, when said at least one frangible blank has been removed, said service fitting accommodation, in use, being open along said length thereof to permit a service fitting to be laid sideways therein.

22. The combination of claim 21 wherein said insulation member has respective first and second stud interface fittings defining respective accommodations for said first and second studs, and said respective accommodations are each less deep in the through-thickness direction of said wall construction than the width of said first and second studs in the through-thickness direction of said wall construction.

23. The combination of claim 21 wherein said service fitting accommodation is filled with a frangibly removable frangible blank.

24. The combination of claim 21 wherein said insulation member is provided with a blank that is frangibly removable from said service fitting accommodation.

25. The combination of claim 22 wherein said combination includes at least said first stud, said second stud, and a third stud; and at least two adjacent cavities defined to either side of said first stud accommodation is a first stud channel defined in said insulation member; said first stud seats in said first stud channel, and said service fitting accommodation runs along said first stud adjacent to said first stud channel.

26. The insulation member of claim 1 wherein said first and second stud accommodations are spaced to received studs in an array of studs formed on one of (a) 12" centers; (b) 16" centers; (c) 19.2" centers; (d) 24" centers.

27. The combination of claim 25 wherein said service fitting accommodation runs along, and is accessible from, a height-wise and width-wise extending face of said plug, and is exposed by removal of said frangibly removable blank.

28. A single piece thermal Insulation member for use in conjunction with framing studs, said thermal insulation member having a frangible member running along a face thereof, said frangible member being removable to leave an exposed service chase bordering one of the framing studs, said service chase having a length, a width and a depth, said length being greater than each of said width and said depth, said length running along said face of said thermal insulation member, said depth extending from said face of said thermal insulation member into said thermal insulation member, and said chase being open on one side along said length, said side being accessible from said face of said thermal insulation member, whereby a service fitting may be laid sideways into said chase when said frangible member has been removed.

* * * * *